US008608594B2

(12) United States Patent
Isogawa et al.

(10) Patent No.: US 8,608,594 B2
(45) Date of Patent: Dec. 17, 2013

(54) GOLF BALL

(75) Inventors: Kazuhiko Isogawa, Kobe (JP); Tsutomu Hirau, Kobe (JP); Hirotaka Nakamura, Kobe (JP); Takahiro Shigemitsu, Kobe (JP)

(73) Assignee: Dunlop Sports Co. Ltd., Kobe-Shi (JP)

( * ) Notice: Subject to any disclaimer, the term of this patent is extended or adjusted under 35 U.S.C. 154(b) by 853 days.

(21) Appl. No.: 12/617,909

(22) Filed: Nov. 13, 2009

(65) Prior Publication Data

US 2010/0160080 A1 Jun. 24, 2010

(30) Foreign Application Priority Data

Dec. 22, 2008 (JP) ..... 2008-324937
Dec. 22, 2008 (JP) ..... 2008-325014

(51) Int. Cl.
*A63B 37/06* (2006.01)

(52) U.S. Cl.
USPC ..... 473/376

(58) Field of Classification Search
USPC ..... 473/376
See application file for complete search history.

(56) References Cited

U.S. PATENT DOCUMENTS 5,688,595 A 11/1997 Yamagishi et al.
5,725,442 A * 3/1998 Higuchi et al. ..... 473/376
6,152,834 A * 11/2000 Sullivan ..... 473/365
6,962,951 B1 11/2005 Takesue et al.
2002/0034987 A1 3/2002 Yamagishi et al.
2002/0099120 A1 7/2002 Takesue et al.
2002/0173380 A1 11/2002 Ohama et al.
2003/0109333 A1 6/2003 Yamagishi et al.
2004/0132552 A1 7/2004 Chen
2005/0170909 A1 8/2005 Hayashi
2005/0256269 A1 11/2005 Takesue et al.

FOREIGN PATENT DOCUMENTS

JP 2005-218859 A 8/2005
JP 2006-87949 A 4/2006
JP 2006-230661 A 9/2006

OTHER PUBLICATIONS

Office Action for corresponding Japanese Application No. 2008-324937 dated May 10, 2011.
Office Action for corresponding Japanese Application No. 2008-325014 dated May 10, 2011.

* cited by examiner

*Primary Examiner* — Raeann Gorden
(74) *Attorney, Agent, or Firm* — Birch, Stewart, Kolasch & Birch, LLP

(57) ABSTRACT

A first golf ball 2 includes a core 4, a mid-layer 6, and a cover 8. The core 4 includes a center 10 and an envelope layer 12. The mid-layer 6 includes a metal ion source (C) that can neutralize an ionomer resin. The mid-layer 6 has a melt flow rate (at 190° C. and 2.16 kg) of 4 g/10 minute or greater. The difference (H3-H1) between the JIS-C hardness H3 of the cover 8 and the JIS-C central hardness H1 of the center 10 is equal to or greater than 45. A second golf ball 22 includes a core 24, a mid-layer 28, and a cover 30. The mid-layer 28 has a melt flow rate (at 190° C. and 2.16 kg) of 4 g/10 minute or greater. Preferably, the mid-layer 28 includes a high melt viscosity resin (A), a low melt viscosity ionomer resin (B), and a metal ion source (C1).

9 Claims, 2 Drawing Sheets

GOLF BALL

This application claims priority on Patent Application No. 2008-324937 filed in JAPAN on Dec. 22, 2008 and Patent Application No. 2008-325014 filed in JAPAN on Dec. 22, 2008. The entire contents of these Japanese Patent Applications are hereby incorporated by reference.

BACKGROUND OF THE INVENTION

1. Field of the Invention

The present invention relates to golf balls. Specifically, the present invention relates to multi-piece golf balls.

2. Description of the Related Art

Golf players' foremost requirement for golf balls is flight performance. Flight performance correlates with the resilience performance of a ball. High resilience performance increases an initial speed, thereby achieving a long flight distance. In light of flight performance, a golf ball with high resilience performance is desired. In addition, generally, golf players prefer soft feel at impact.

Spin performance also correlates with flight performance. Flight at a low spin rate results in a proper trajectory, thereby achieving a long flight distance. In light of flight performance, a golf ball with high resilience performance and to which spin is difficult to impart, is desired.

The diameter of a core formed from a rubber composition correlates with the resilience performance of a ball. When the diameter of the core is large, the resilience performance of the ball is high.

JPH08-336617 (U.S. Pat. No. 5,688,595, US2003/109333, US2002/034987) and JPH09-56848 (U.S. Pat. No. 5,725,442) disclose multi-piece solid golf balls with a four-layer structure. These publications describe that a spin rate is suppressed and a flight distance is increased due to the rigidity distribution of a ball, and the like.

On the other hand, there has been an attempt to enhance resilience performance due to the material of an outer layer. JP No. 3767683 (US2002/099120) and JP No. 3729243 (U.S. Pat. No. 6,962,951, US2005/256269) disclose golf ball materials that include an ionomer and an aliphatic acid as essential components. JP2002-239033 (US2002/173380) discloses an inner cover in which an ionomer resin is blended with a styrene elastomer.

JP2006-500995 (US2004/132552) discloses an ionomer cover that is flexible and elastic. This ionomer cover includes: a carboxylate functionalized terpolymer with a weight average molecular weight of 80,000 or greater and 500,000 or less; and carboxylate functionalized ethylene with a weight average molecular weight of 2,000 or greater and 30,000 or less.

SUMMARY OF THE INVENTION

For further enhancing the resilience performance, preferably, a core formed from a rubber composition is made to be larger in size, and an outer layer with excellent resilience performance is used. However, when the core is large in size, the outer layer needs to be thin. An outer layer material that is easily molded so as to be thin is desired.

The materials disclosed in JP No. 3767683 and JP No. 3729243 include an aliphatic acid, and hence bleeding can occur. Due to this bleeding, the adhesion with adjacent layers decreases. Due to the decrease of the adhesion, the durability of the golf ball decreases. In addition, when an aliphatic acid is used, smoke may be generated during molding.

The material disclosed in JP2002-239033 has low fluidity, and hence is unsuitable for molding a thin layer.

Golf players' requirements for golf balls have been escalated more than ever. An objective of the present invention is to provide a golf ball having excellent flight performance, excellent durability, and excellent feel at impact.

A golf ball of a first aspect comprises a center, an envelope layer positioned outside the center, a mid layer positioned outside the envelope layer, and a cover positioned outside the mid layer. The center has a diameter of 5 mm or greater and 19 mm or less. The center has a rubber percentage of 73% by weight or greater. The center has a JIS-C central hardness H1 of 20 or greater and 50 or less. The envelope layer has an outer diameter of 37.0 mm or greater. The mid layer has a JIS-C hardness H2 less than the JIS-C hardness H3 of the cover. The principal component of the mid layer is an ionomer resin. The mid layer includes a metal ion source (C) that can neutralize the ionomer resin. The mid layer has a melt flow rate, measured under the conditions of: a temperature of 190° C. and a load of 2.16 kg, of 4 g/10 min or greater. The difference (H3−H1) between the JIS-C hardness H3 of the cover and the JIS-C central hardness H1 of the center is equal to or greater than 45.

Preferably, the mid layer includes a composition (M) that is formed from: a high melt viscosity resin (A) that is an ionomer resin (a-1), a nonionic resin (a-2), or a mixture of the ionomer resin (a-1) and the nonionic resin (a-2); a low melt viscosity ionomer resin (B) that is at least one or more types selected from two types of: a metal ion neutralized product (b-1) of a binary copolymer formed with ethylene and an α,β-unsaturated carboxylic acid having 3 to 8 carbon atoms; and a metal ion neutralized product (b-2) of a ternary copolymer formed with ethylene, an α,β-unsaturated carboxylic acid having 3 to 8 carbon atoms, and an α,β-unsaturated carboxylic acid ester, the low melt viscosity ionomer resin (B) having a melt viscosity (190° C.), measured with a Brookfield viscometer, of 1 Pa·s or greater and 10 Pa·s or less; and a metal ion source (C1) that can neutralize carboxyl groups in the high melt viscosity resin (A) and the low melt viscosity ionomer resin (B). Preferably, the weight ratio A1/B1 of the high melt viscosity resin (A) with respect to the low melt viscosity ionomer resin (B) is equal to or greater than 55/45 and equal to or less than 99/1. Preferably, the amount of the metal ion source (C1) is equal to or greater than 0.1 part by weight and equal to or less than 10 parts by weight, per total 100 parts by weight of the high melt viscosity resin (A) and the low melt viscosity ionomer resin (B).

The ionomer resin (a-1) is a high melt viscosity ionomer resin that is at least one or more types selected from two types of: a metal ion neutralized product (a-11) of a binary copolymer formed with ethylene and an α,β-unsaturated carboxylic acid having 3 to 8 carbon atoms; and a metal ion neutralized product (a-12) of a ternary copolymer formed with ethylene, an α,β-unsaturated carboxylic acid having 3 to 8 carbon atoms, and an α,β-unsaturated carboxylic acid ester. The high melt viscosity ionomer resin (a-1) has a melt viscosity (190° C.), measured with a flow tester, of 500 Pa·s or greater and 100000 Pa·s or less.

The nonionic resin (a-2) is a high melt viscosity nonionic resin that is at least one or more types selected from two types of: a binary copolymer (a-21) formed with ethylene and an α,β-unsaturated carboxylic acid having 3 to 8 carbon atoms; and a ternary copolymer (a-22) formed with ethylene, an α,β-unsaturated carboxylic acid having 3 to 8 carbon atoms, and an α,β-unsaturated carboxylic acid ester. The high melt viscosity nonionic resin (a-2) has a melt viscosity (190° C.), measured with a flow tester, of 5 Pa·s or greater and 3000 Pa·s or less.

Preferably, the mid layer includes a thermoplastic resin (D) in an amount that is equal to or greater than 1 part by weight and equal to or less than 95 parts by weight per total 100 parts by weight of the high melt viscosity resin (A) and the low melt viscosity ionomer resin (B).

Preferably, the mid layer has a specific gravity of 1.10 or greater and 1.50 or less.

Preferably, the cover has a thickness of 0.3 mm or greater and 1.6 mm or less.

A golf ball of a second aspect comprises a core, a mid layer positioned outside the core, and a cover positioned outside the mid layer. The cover has a thickness of 0.3 mm or greater and 1.6 mm or less. The cover has a Shore D hardness Hc of 56 or greater. The mid layer has a thickness of 0.5 mm or greater and 1.6 mm or less. The mid layer has a Shore D hardness Hm of 35 or greater and 57 or less. The mid layer has a melt flow rate, measured under the conditions of: a temperature of 190° C. and a load of 2.16 kg, of 4 g/10 min or greater.

Preferably, the mid layer includes a composition (M) that is formed from: a high melt viscosity resin (A) that is an ionomer resin (a-1), a nonionic resin (a-2), or a mixture of the ionomer resin (a-1) and the nonionic resin (a-2); a low melt viscosity ionomer resin (B) that is at least one or more types selected from two types of: a metal ion neutralized product (b-1) of a binary copolymer formed with ethylene and an α,β-unsaturated carboxylic acid having 3 to 8 carbon atoms; and a metal ion neutralized product (b-2) of a ternary copolymer formed with ethylene, an α,β-unsaturated carboxylic acid having 3 to 8 carbon atoms, and an α,β-unsaturated carboxylic acid ester, the low melt viscosity ionomer resin (B) having a melt viscosity (190° C.), measured with a Brookfield viscometer, of 1 Pa·s or greater and 10 Pa·s or less; and a metal ion source (C1) that can neutralize carboxyl groups in the high melt viscosity resin (A) and the low melt viscosity ionomer resin (B). Preferably, the weight ratio A1/B1 of the high melt viscosity resin (A) with respect to the low melt viscosity ionomer resin (B) is equal to or greater than 55/45 and equal to or less than 99/1. Preferably, the amount of the metal ion source (C1) is equal to or greater than 0.1 part by weight and equal to or less than 10 parts by weight, per total 100 parts by weight of the high melt viscosity resin (A) and the low melt viscosity ionomer resin (B).

The ionomer resin (a-1) is a high melt viscosity ionomer resin that is at least one or more types selected from two types of: a metal ion neutralized product (a-11) of a binary copolymer formed with ethylene and an α,β-unsaturated carboxylic acid having 3 to 8 carbon atoms; and a metal ion neutralized product (a-12) of a ternary copolymer formed with ethylene, an α,β-unsaturated carboxylic acid having 3 to 8 carbon atoms, and an α,β-unsaturated carboxylic acid ester. The high melt viscosity ionomer resin (a-1) has a melt viscosity (190° C.), measured with a flow tester, of 500 Pa·s or greater and 100000 Pa·s or less.

The nonionic resin (a-2) is a high melt viscosity nonionic resin that is at least one or more types selected from two types of: a binary copolymer (a-21) formed with ethylene and an α,β-unsaturated carboxylic acid having 3 to 8 carbon atoms; and a ternary copolymer (a-22) formed with ethylene, an α,β-unsaturated carboxylic acid having 3 to 8 carbon atoms, and an α,β-unsaturated carboxylic acid ester. The high melt viscosity nonionic resin (a-2) has a melt viscosity (190° C.), measured with a flow tester, of 5 Pa·s or greater and 3000 Pa·s or less.

Preferably, the mid layer includes a thermoplastic resin (D) in an amount that is equal to or greater than 1 part by weight and equal to or less than 95 parts by weight per total 100 parts by weight of the high melt viscosity resin (A) and the low melt viscosity ionomer resin (B).

Preferably, the mid layer has a specific gravity of 1.10 or greater and 1.50 or less.

Preferably, the core has a diameter of 38.0 mm or greater.

In the golf ball according to the first aspect, it is possible to suppress spin. The mid layer of the golf ball has excellent fluidity in molding. This fluidity makes it possible to mold a thin layer. Due to the thin mid layer, the core can be made to be larger in size. The golf ball has excellent flight performance, excellent feel at impact, and excellent durability.

The mid layer of the golf ball according to the second aspect has excellent fluidity in molding. This fluidity makes it possible to mold a thin layer. Due to the thin mid layer, the core can be made to be larger in size. The mid layer can contribute to improvement of the resilience performance of the golf ball. In the golf ball, the mid layer contributes to flight performance and durability.

DESCRIPTION OF THE PREFERRED EMBODIMENTS

The following will describe in detail the present invention based on preferred embodiments with reference to the accompanying drawings.

First, a golf ball 2 of a first embodiment will be described.

Figure 1:
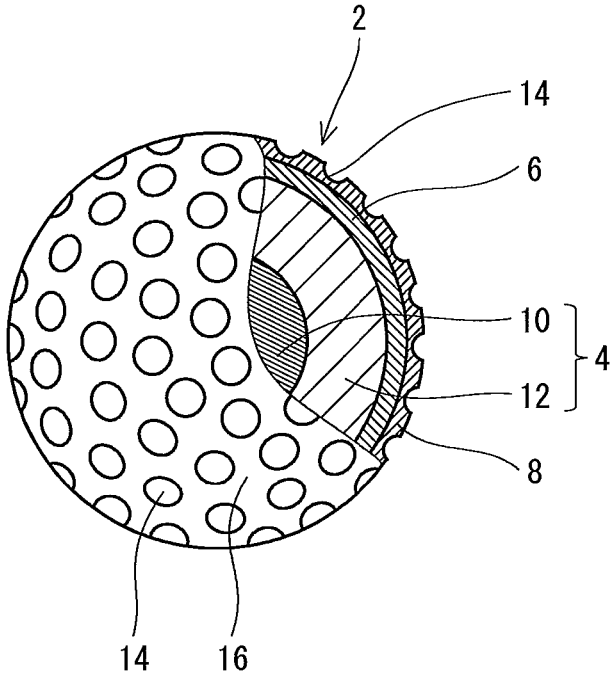
FIG. 1 is a schematic cross-sectional view of a golf ball according to a first embodiment of the present invention.

Referring to FIG. 1, the golf ball 2 of the first embodiment includes a spherical core 4, a mid layer 6 positioned outside the core 4, and a cover 8 positioned outside the mid layer 6. The core 4 includes a spherical center 10 and an envelope layer 12 positioned outside the center 10. On the surface of the cover 8, a large number of dimples 14 are formed. Of the surface of the golf ball 2, a part other than the dimples 14 is a land 16. The golf ball 2 includes a paint layer and a mark layer on the external side of the cover 8 although these layers are not shown in the drawing.

The golf ball 2 has a diameter of 40 mm or greater and 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater and 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

The center 10 is obtained by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferred. When another rubber is used in combination with a polybutadiene, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

In the present specification, a rubber percentage of the center 10 is defined. The rubber percentage is determined based on the ratio of the materials of the center 10. Where Wr denotes the weight of the rubber material and Wa denotes the total weight of the materials other than the rubber material, a rubber percentage R1 (% by weight) is obtained by the following formula.

$$R1=100*Wr/(Wr+Wa)$$

The specific gravities of the materials other than the rubber, such as a co-crosslinking agent, an inorganic filler, and the like, are normally greater than the specific gravity of the rubber. A high rubber percentage R1 can decrease the specific gravity of the center 10. Due to the center 10 with a low specific gravity, the weight distribution of the golf ball 2 is biased such that the weight is greater on the outer side than on the inner side. Due to this bias, the moment of inertia of the golf ball 2 improves. A high moment of inertia decreases a spin rate. A low backspin rate contributes to an increase of flight distance. A low side spin rate suppresses curving of a trajectory.

In light of suppression of spin, the rubber percentage R1 is preferably equal to or greater than 73% by weight, more preferably equal to or greater than 79% by weight, and even more preferably equal to or greater than 85% by weight. In light of including a co-crosslinking agent and the like which can enhance the resilience performance, the rubber percentage R1 is preferably equal to or less than 90% by weight and more preferably equal to or less than 87% by weight, In light of suppression of spin, the specific gravity of the center 10 is preferably equal to or less than 1.15 and more preferably equal to or less than 1.13. In light of including a co-crosslinking agent and the like which can enhance the resilience performance, the specific gravity of the center 10 is preferably equal to or greater than 1.00.

Preferably, the rubber composition of the center 10 includes a co-crosslinking agent. The co-crosslinking agent achieves high resilience of the center 10. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 5 parts by weight and more preferably equal to or greater than 7 parts by weight, per 100 parts by weight of the base rubber. In light of decrease in the specific gravity of the center 10 and soft feel at impact, the amount of the co-crosslinking agent is preferably equal to or less than 30 parts by weight, more preferably equal to or less than 20 parts by weight, and even more preferably equal to or less than 14 parts by weight, per 100 parts by weight of the base rubber.

Preferably, the rubber composition of the center 10 includes an organic peroxide together with a co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy) hexane, and di-t-butyl peroxide. In light of versatility, dicumyl peroxide is preferred.

In light of resilience performance of the golf ball 2, the amount of the organic peroxide is preferably equal to or greater than 0.1 part by weight, more preferably equal to or greater than 0.3 part by weight, and particularly preferably equal to or greater than 0.5 part by weight, per 100 parts by weight of the base rubber. In light of decrease in the specific gravity of the center 10 and soft feel at impact, the amount of the organic peroxide is preferably equal to or less than 3.0 parts by weight, more preferably equal to or less than 2.8 parts by weight, even more preferably equal to or less than 2.5 parts by weight, and particularly preferably equal to or less than 1.0 part by weight, per 100 parts by weight of the base rubber.

Preferably, the rubber composition of the center 10 includes an organic sulfur compound. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, and bis(4-cyanophenyl)disulfide; disubstitutions such as bis(2,5-dichlorophenyl)disulfide, bis (3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis (2-cyano-5-bromophenyl)disulfide; trisubstitutions such as bis(2,4,6-trichlorophenyl)disulfide and bis(2-cyano-4-chloro-6-bromophenyl)disulfide; tetrasubstitutions such as bis(2,3,5,6-tetrachlorophenyl)disulfide; and as bis(2,3,4,5,6-pentachlorophenyl)disulfide and bis(2,3,4,5,6-pentabromophenyl)disulfide. The organic sulfur compound contributes to resilience performance. Particularly preferable organic sulfur compounds are diphenyl disulfide and bis (pentabromophenyl)disulfide.

In light of resilience performance of the golf ball 2, the amount of the organic sulfur compound is preferably equal to or greater than 0.1 part by weight and more preferably equal to or greater than 0.2 part by weight, per 100 parts by weight of the base rubber. In light of decrease in the specific gravity of the center 10 and soft feel at impact, the amount of the organic sulfur compound is preferably equal to or less than 1.5 parts by weight, more preferably equal to or less than 1.0 part by weight, and particularly preferably equal to or less than 0.8 part by weight, per 100 parts by weight of the base rubber.

For the purpose of adjusting specific gravity and the like, a filler may be included in the center 10. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the center 10 is accomplished. A particularly preferable filler is zinc oxide. Zinc oxide serves not only as a specific gravity adjuster but also as a crosslinking activator. According to need, various additives such as an anti-aging agent, a coloring agent, a plasticizer, a dispersant, and the like are included in the center 10 in an adequate amount. Crosslinked rubber powder or synthetic resin powder may be also included in the center 10. The amount of the filler is adjusted such that the rubber percentage R1 is equal to or greater than 73% by weight.

In light of resilience performance, the center 10 has a central hardness H1 of preferably 20 or greater, more preferably 23 or greater, and particularly preferably 26 or greater. In light of suppression of spin, the central hardness H1 is preferably equal to or less than 50, more preferably equal to or less than 48, and particularly preferably equal to or less than 45. The central hardness H1 is measured by pressing a JIS-C type hardness scale against the central point of a cut plane of the center 10 that has been cut into two halves. For the measurement, an automated rubber hardness measurement machine (trade name "P1", available from Kobunshi Keiki Co., Ltd.), to which this hardness scale is mounted, is used.

In light of achievement of an outer-hard/inner-soft structure, the center 10 has a surface hardness H5 of preferably 30 or greater, more preferably 35 or greater, and particularly preferably 40 or greater. In light of feel at impact, the surface hardness H5 is preferably equal to or less than 70, more preferably equal to or less than 60, and even more preferably equal to or less than 58. The surface hardness H5 is measured by pressing a JIS-C type hardness scale against the surface of the center 10. For the measurement, an automated rubber hardness measurement machine (trade name "P1", available from Kobunshi Keiki Co., Ltd.), to which this hardness scale is mounted, is used.

In light of feel at impact, the center 10 has the amount of compressive deformation of preferably 0.5 mm or greater, more preferably 1.0 mm or greater, and particularly preferably 1.1 mm or greater. In light of resilience performance, the amount of compressive deformation is preferably equal to or less than 2.5 mm, more preferably equal to or less than 2.3 mm, and particularly preferably equal to or less than 2.0 mm.

Upon measurement of the amount of compressive deformation, first, a sphere is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load is applied to the sphere up to the state in which a final load is applied thereto, is the amount of compressive deformation. In measuring the amount of compressive deformation of the center 10, the initial load is 0.3 N and the final load is 29.4 N. In measuring: the amount of compressive deformation of the core 4; the amount of compressive deformation of a sphere consisting of the core 4 and the mid layer 6; and the amount of compressive deformation of the golf ball 2, the initial load is 98 N and the final load is 1274 N.

The center 10 has a diameter less than that of the center of a general golf ball. Due to the small center 10, the envelope layer 12 can be formed with a sufficient thickness. Due to the envelope layer 12, degree of freedom in designing the hardness distribution of the core increases. The envelope layer 12 can achieve an outer-hard/inner-soft structure. Even if being flexible, the small center 10 does not impair the resilience performance of the golf ball 2. In light of resilience performance, the diameter of the center 10 is preferably equal to or less than 19 mm, more preferably equal to or less than 18 mm, even more preferably equal to or less than 16 mm, and particularly preferably equal to or less than 15 mm. From the standpoint that the center 10 can contribute to suppression of spin, the diameter is preferably equal to or greater than 5 mm, more preferably equal to or greater than 6 mm, and particularly preferably equal to or greater than 8 mm.

The center 10 has a weight of preferably 0.05 g or greater and 4 g or less. The temperature for crosslinking the center 10 is generally equal to or higher than 140° C. and equal to or lower than 180° C. The time period for crosslinking the center 10 is generally equal to or longer than 5 minutes and equal to or shorter than 60 minutes. The center 10 may be formed with two or more layers. The center 10 may have a rib on the surface thereof.

The envelope layer 12 is obtained by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferred. When another rubber is used in combination with a polybutadiene, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

In order to crosslink the envelope layer 12, a co-crosslinking agent is preferably used. Examples of preferable co-crosslinking agents in light of resilience performance include monovalent or bivalent metal salts of an $\alpha,\beta$-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 10 parts by weight, more preferably equal to or greater than 15 parts by weight, and particularly preferably equal to or greater than 20 parts by weight, per 100 parts by weight of the base rubber. In light of soft feel at impact, the amount of the co-crosslinking agent is preferably equal to or less than 50 parts by weight, more preferably equal to or less than 45 parts by weight, and particularly preferably equal to or less than 40 parts by weight, per 100 parts by weight of the base rubber.

In light of moment of inertia of the golf ball 2, the envelope layer 12 has a specific gravity preferably greater than the specific gravity of the center 10. In light of achievement of both desired resilience performance and desired moment of inertia of the golf ball 2, the amount of the co-crosslinking agent per 100 parts by weight of the base rubber is preferably greater than that in the center 10. In other words, where K1 (parts by weight) denotes the amount of the co-crosslinking agent per 100 parts by weight of the base rubber in the envelope layer 12 and K2 (parts by weight) denotes the amount of the co-crosslinking agent per 100 parts by weight of the base rubber in the center 10, K1 is preferably greater than K2. The difference (K1−K2) is more preferably equal to or greater than 10 and even more preferably equal to or greater than 20.

Preferably, the rubber composition of the envelope layer 12 includes an organic peroxide together with a co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy) hexane, and di-t-butyl peroxide. In light of versatility, dicumyl peroxide is preferred.

In light of resilience performance of the golf ball 2, the amount of the organic peroxide is preferably equal to or greater than 0.1 part by weight, more preferably equal to or greater than 0.3 part by weight, and particularly preferably equal to or greater than 0.5 part by weight, per 100 parts by weight of the base rubber. In light of soft feel at impact, the amount of the organic peroxide is preferably equal to or less than 3.0 parts by weight, more preferably equal to or less than 2.8 parts by weight, and particularly preferably equal to or less than 2.5 parts by weight, per 100 parts by weight of the base rubber.

Preferably, the rubber composition of the envelope layer 12 includes an organic sulfur compound. The organic sulfur compounds described above for the center 10 can be used for the envelope layer 12. In light of resilience performance of the golf ball 2, the amount of the organic sulfur compound is preferably equal to or greater than 0.1 part by weight and more preferably equal to or greater than 0.2 part by weight, per 100 parts by weight of the base rubber. In light of soft feel at impact, the amount of the organic sulfur compound is preferably equal to or less than 1.5 parts by weight, more preferably equal to or less than 1.0 part by weight, and particularly preferably equal to or less than 0.8 part by weight, per 100 parts by weight of the base rubber.

For the purpose of adjusting specific gravity and the like, a filler may be included in the envelope layer 12. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the envelope layer 12 is accomplished. A particularly preferable filler is zinc oxide. Zinc oxide serves not only as a specific gravity adjuster but also as a crosslinking activator. According to need, various additives such as sulfur, an anti-aging agent, a coloring agent, a plasticizer, a dispersant, and the like are included in the envelope layer 12 in an adequate amount. Crosslinked rubber powder or synthetic resin powder may be also included in the envelope layer 12.

In light of achievement of an outer-hard/inner-soft structure, the core 4 has a surface hardness H4 of preferably 65 or greater, more preferably 75 or greater, even more preferably 80 or greater, and particularly preferably 83 or greater. In light of feel at impact, the surface hardness H4 is preferably equal to or less than 95, more preferably equal to or less than 93, even more preferably equal to or less than 92, and particularly preferably equal to or less than 90. The surface hardness H4 is measured by pressing a JIS-C type hardness scale against the surface of the core 4. For the measurement, an automated rubber hardness measurement machine (trade name "P1", available from Kobunshi Keiki Co., Ltd.), to which this hardness scale is mounted, is used.

In light of resilience performance, the envelope layer 12 has a thickness of preferably 10 mm or greater, more preferably 11 mm or greater, and even more preferably 12 mm or greater. The thickness of the envelope layer 12 is preferably equal to or less than 20 mm, more preferably equal to or less than 19 mm, and particularly preferably equal to or less than 18 mm.

During formation of the envelope layer 12, the center is covered with two uncrosslinked or semi-crosslinked half shells. These half shells are compressed and heated. By this heating, a crosslinking reaction takes place to complete the envelope layer 12. The crosslinking temperature is generally equal to or higher than 140° C. and equal to or lower than 180° C. The time period for crosslinking the envelope layer 12 is generally equal to or longer than 10 minutes and equal to or shorter than 60 minutes.

In light of feel at impact, the core 4 has the amount of compressive deformation of preferably 2.3 mm or greater, more preferably 2.4 mm or greater, and particularly preferably 2.5 mm or greater. In light of resilience performance, the amount of compressive deformation is preferably equal to or less than 4.0 mm, more preferably equal to or less than 3.9 mm, and particularly preferably equal to or less than 3.8 mm.

In light of resilience performance, the core 4 has a diameter of preferably 37.0 mm or greater, more preferably 38.0 mm or greater, and particularly preferably 38.5 mm or greater. In light of durability of the golf ball 2, the diameter of the core 4 is preferably equal to or less than 40.2 mm, more preferably equal to or less than 39.9 mm, and particularly preferably equal to or less than 39.6 mm.

A resin composition is suitably used for the mid layer 6. The principal component of the mid layer 6 is an ionomer resin. In other words, the proportion of the ionomer resin to the entire base polymer is equal to or greater than 50% by weight. This proportion is calculated based on the weight ratio of materials. In light of resilience performance, this proportion is preferably equal to or greater than 70% by weight and more preferably equal to or greater than 80% by weight.

An ionomer resin and another resin may be used in combination. Examples of resins used in combination include styrene block-containing thermoplastic elastomers, thermoplastic polyester elastomers, thermoplastic polyamide elastomers, and thermoplastic polyolefin elastomers.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. This binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. This ternary copolymer has excellent resilience performance. For the binary copolymer and ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320", and "Himilan MK7329", available from Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", available from E.I. du Pont de Nemours and Company; and trade names "IOTEK 7010", "IOTEK 7030", "IOTEK 7510", "IOTEK 7520", "IOTEK 8000", and "IOTEK 8030", available from ExxonMobil Chemical Corporation.

Two or more types of ionomer resins may be used in combination for the mid layer 6. An ionomer resin neutralized with a monovalent metal ion, and an ionomer resin neutralized with a bivalent metal ion may be used in combination.

The mid layer 6 includes a metal ion source (C) that can neutralize the ionomer resin. As the metal ion source (C), sources that are described as a below-described metal ion source (C1) can be used.

Preferably, the mid layer 6 includes a composition (M) that is formed from a high melt viscosity resin (A), a low melt viscosity ionomer resin (B), and the metal ion source (C1). The composition (M) may include a compound in addition to the resin (A), the resin (B), and the metal ion source (C1).

In light of enhancement of an effect caused by the composition (M), the proportion of the composition (M) in the mid layer 6 is preferably equal to or greater than 50% by weight, more preferably equal to or greater than 60% by weight, and even more preferably equal to or greater than 70% by weight. This proportion may be 100% by weight.

In the composition (M), how much extent the metal ion source (C1) neutralizes the resin (A) and the resin (B) is not limited. At least a part of a later-described resin (a-2) may be neutralized by the metal ion source (C1). All carboxyl groups in the resin (a-2) may be neutralized by the metal ion source (C1). The resin (a-2) may not be neutralized by the metal ion source (C1).

Any weight ratios and percentages by weight that are described in the present specification are blend ratios of materials. Due to chemical reactions of materials, weight ratios and percentages by weight in the golf ball 2 may be different from the blend ratios of the materials.

The high melt viscosity resin (A) is a below-described ionomer resin (a-1), the below-described nonionic resin (a-2), or a mixture of the resin (a-1) and the resin (a-2).

The low melt viscosity ionomer resin (B) is at least one or more types selected from two types of: a metal ion neutralized product (b-1) of a binary copolymer formed with ethylene and an α,β-unsaturated carboxylic acid having 3 to 8 carbon atoms; and a metal ion neutralized product (b-2) of a ternary copolymer formed with ethylene, an α,β-unsaturated carboxylic acid having 3 to 8 carbon atoms, and an α,β-unsaturated carboxylic acid ester. The low melt viscosity ionomer resin (B) has a melt viscosity (190° C.), measured with a Brookfield viscometer, of 1 Pa·s or greater and 10 Pa·s or less.

The metal ion source (C1) is a compound that can neutralize carboxyl groups in the high melt viscosity resin (A) and the low melt viscosity ionomer resin (B).

First, the ionomer resin (a-1) that can be used as the high melt viscosity resin (A) will be described.

The ionomer resin (a-1) is one or two types selected from the group consisting of a neutralized product (a-11) and a neutralized product (a-12).

The neutralized product (a-11) is a compound obtained by neutralizing at least some of carboxyl groups in a binary copolymer formed with ethylene and an α,β-unsaturated carboxylic acid having 3 to 8 carbon atoms, with metal ions.

The neutralized product (a-12) is a compound obtained by neutralizing at least some of carboxyl groups in a ternary copolymer formed with ethylene, an α,β-unsaturated carboxylic acid having 3 to 8 carbon atoms, and an α,β-unsaturated carboxylic acid ester, with metal ions.

The ionomer resin (a-1) may be a mixture of the neutralized product (a-11) and the neutralized product (a-12).

The ionomer resin (a-1) has a melt viscosity (190° C.), measured with a flow tester, of 500 Pa·s or greater and 100000 Pa·s or less.

Examples of the α,β-unsaturated carboxylic acid having 3 to 8 carbon atoms include acrylic acid, methacrylic acid, fumaric acid, maleic acid, and crotonic acid. Particularly, acrylic acid and methacrylic acid are preferred.

Examples of the α,β-unsaturated carboxylic acid ester include methyl esters of acrylic acid, methacrylic acid, fumaric acid, maleic acid, and the like; ethyl esters of acrylic acid, methacrylic acid, fumaric acid, maleic acid, and the like; propyl esters of acrylic acid, methacrylic acid, fumaric acid, maleic acid, and the like; n-butyl esters of acrylic acid, methacrylic acid, fumaric acid, maleic acid, and the like; and isobutyl esters of acrylic acid, methacrylic acid, fumaric acid, maleic acid, and the like. Particularly, acrylic acid esters and methacrylic acid esters are preferred. The carbon number of the α,β-unsaturated carboxylic acid that is the material for the α,β-unsaturated carboxylic acid ester is preferably equal to or greater than 3 and equal to or less than 8.

Examples of metal ions for neutralizing at least some of the carboxyl groups in the neutralized product (a-11) and the neutralized product (a-12) include monovalent alkali metal ions such as sodium, potassium, and lithium; bivalent metal ions such as magnesium, calcium, zinc, barium, and cadmium; trivalent metal ions such as aluminum; and other ions such as tin and zirconium. Bivalent metal ions such as magnesium, calcium, zinc, barium, and cadmium are preferred, and zinc and magnesium are more preferred. When a bivalent metal ion is used, the durability and the low-temperature durability of the resultant golf ball improve. Thus, bivalent metal ions are preferred.

Preferably, the ionomer resin (a-1) is: a compound obtained by neutralizing at least some of carboxyl groups in a binary copolymer formed with ethylene and (meth)acrylic acid, with metal ions; a compound obtained by neutralizing at least some of carboxyl groups in a ternary copolymer formed with ethylene, (meth)acrylic acid, and a (meth)acrylic acid ester, with metal ions; or a mixture thereof. In the present specification, (meth)acrylic acid indicates acrylic acid and/or methacrylic acid.

One example of a more preferable high melt viscosity ionomer resin (a-1) is a mixture (M1) of the following compound (a-1-1) and compound (a-1-2):

(a-1-1) a compound obtained by neutralizing at least some of carboxyl groups in a binary copolymer formed with ethylene and (meth)acrylic acid, with monovalent metal ions, or a compound obtained by neutralizing at least some of carboxyl groups in a ternary copolymer formed with ethylene, (meth) acrylic acid, and a (meth)acrylic acid ester, with monovalent metal ions; and (a-1-2) a compound obtained by neutralizing at least some of carboxyl groups in a binary copolymer formed with ethylene and (meth)acrylic acid, with bivalent metal ions, or a compound obtained by neutralizing at least some of carboxyl groups in a ternary copolymer formed with ethylene, (meth) acrylic acid, and a (meth)acrylic acid ester, with bivalent metal ions.

Use of the aforementioned ionomer resin mixture (M1) can improve the rebound resilience of the mid layer composition. As the monovalent metal ions, sodium, lithium, potassium, rubidium, cesium, and francium are preferred. As the bivalent metal ions, magnesium, calcium, zinc, beryllium, strontium, barium, and radium are preferred. The ratio (weight ratio) of the compound (a-1-1) with respect to the compound (a-1-2), namely, the weight ratio [(a-1-1)/(a-1-2)], is preferably equal to or greater than 0/100, more preferably equal to or greater than 25/75, and even more preferably equal to or greater than 30/70, and is preferably equal to or less than 80/20, more preferably equal to or less than 77/23, and even more preferably equal to or less than 75/25.

The content of the α,β-unsaturated carboxylic acid component, having 3 to 8 carbon atoms, in the ionomer resin (a-1) is preferably equal to or greater than 2% by weight and more preferably equal to or greater than 3% by weight, and is preferably equal to or less than 30% by weight and more preferably equal to or less than 25% by weight.

The degree of neutralization N1 of the carboxyl groups in the ionomer resin (a-1) is preferably equal to or greater than 20 mol % and more preferably equal to or greater than 30 mol %, and is preferably equal to or less than 90 mol % and more preferably equal to or less than 85 mol %. When the degree of neutralization N1 is equal to or greater than 20 mol %, the resilience and the durability of the golf ball are excellent. When the degree of neutralization N1 is equal to or less than 90 mol %, the fluidity of the mid layer composition is excellent and hence the moldability thereof is excellent.

Where N2 (mole) denotes the number of moles of carboxyl groups neutralized in the high melt viscosity ionomer resin (a-1) and T1 (mole) denotes the total number of moles of the carboxyl groups in the ionomer resin (a-1), the degree of neutralization N1 (mol %) of the ionomer resin (a-1) can be calculated using the following formula.

$$N1=100*(N2/T1)$$

The melt viscosity (190° C.), measured with the flow tester, of the high melt viscosity ionomer resin (a-1) is equal to or greater than 500 Pa·s, preferably equal to or greater than 1000 Pa·s, and more preferably equal to or greater than 1500 Pa·s, and is equal to or less than 100000 Pa·s, preferably equal to or less than 95000 Pa·s, and more preferably equal to or less than 92000 Pa·s. When the melt viscosity (190° C.) of the ionomer resin (a-1) is equal to or greater than 500 Pa·s, the durability of the golf ball improves. When the melt viscosity (190° C.) of the ionomer resin (a-1) is equal to or less than 100000 Pa·s, the moldability of the mid layer is excellent.

Examples of the high melt viscosity ionomer resin (a-1) include trade name "Himilan" available from Du Pont-MITSUI POLYCHEMICALS Co., Ltd., and specific examples thereof include "Himilan 1555 (Na)", "Himilan 1605 (Na)", "Himilan 1702 (Zn)", "Himilan 1706 (Zn)", "Himilan 1707 (Na)", "Himilan AM7311 (Mg)", "Himilan AM7329 (Zn)", "Himilan 1856 (Na)", and "Himilan 1855 (Zn)".

Examples of the high melt viscosity ionomer resin (a-1) available from E.I. du Pont de Nemours and Company include trade name "Surlyn", and specific examples thereof include "Surlyn 8945 (Na)", "Surlyn 9945 (Zn)", "Surlyn 8140 (Na)", "Surlyn 8150 (Na)", "Surlyn 9120 (Zn)", "Surlyn 9150 (Zn)", "Surlyn 6910 (Mg)", "Surlyn 6120 (Mg)", "Surlyn 7930 (Li)", "Surlyn 7940 (Li)", and "Surlyn AD8546 (Li)".

Specific examples of the ternary copolymer ionomer resin (the neutralized product (a-12)) include "Surlyn 6320 (Mg)", "Surlyn 8120 (Na)", "Surlyn 8320 (Na)", "Surlyn 9320 (Zn)", and "Surlyn 9320W (Zn)", and further include trade name "HPF 1000 (Mg)" and trade name "HPF 2000 (Mg)".

Examples of the high melt viscosity ionomer resin (a-1) available from ExxonMobil Chemical Corporation include trade name "Iotek", and specific examples thereof include "Iotek 8000 (Na)", "Iotek 8030 (Na)", "Iotek 7010 (Zn)", and "Iotek 7030 (Zn)". Specific examples of the ternary copolymer ionomer resin (the neutralized product (a-12)) include trade name "Iotek 7510 (Zn)", and trade name "Iotek 7520 (Zn)". It is noted that Na, Zn, Li, and Mg described in the parentheses after the trade names indicate metal types of neutralizing metal ions.

The following will describe the high melt viscosity nonionic resin (a-2) that can be used as the high melt viscosity resin (A) of the resin component.

The high melt viscosity nonionic resin (a-2) is one or two types selected from the group consisting of a binary copolymer (a-21) and a ternary copolymer (a-22).

The binary copolymer (a-21) is a binary copolymer formed with ethylene and an α,β-unsaturated carboxylic acid having 3 to 8 carbon atoms. In the binary copolymer (a-21), the carboxyl groups are not neutralized.

The ternary copolymer (a-22) is a ternary copolymer formed with ethylene, an α,β-unsaturated carboxylic acid having 3 to 8 carbon atoms, and an α,β-unsaturated carboxylic acid ester. In the ternary copolymer (a-22), the carboxyl groups are not neutralized.

The high melt viscosity nonionic resin (a-2) may be a mixture of the binary copolymer (a-21) and the ternary copolymer (a-22).

The high melt viscosity nonionic resin (a-2) has a melt viscosity (190° C.), measured with a flow tester, of 5 Pa·s or greater and 3000 Pa·s or less.

The same α,β-unsaturated carboxylic acid as used in the ionomer resin (a-1) can be used as the α,β-unsaturated carboxylic acid having 3 to 8 carbon atoms and used in the binary copolymer (a-21) or the ternary copolymer (a-22).

Examples of preferable high melt viscosity nonionic resins (a-2) include: binary copolymers formed with ethylene and (meth)acrylic acid; ternary copolymers formed with ethylene, (meth)acrylic acid and, an (meth)acrylic acid ester; and a mixture thereof.

The content of the α,β-unsaturated carboxylic acid, having 3 to 8 carbon atoms, in the high melt viscosity nonionic resin (a-2) is preferably equal to or greater than 2% by weight and more preferably equal to or greater than 3% by weight, and is preferably equal to or less than 30% by weight and more preferably equal to or less than 25% by weight.

The melt viscosity (190° C.), measured with the flow tester, of the high melt viscosity nonionic resin (a-2) is equal to or greater than 5 Pa·s, preferably equal to or greater than 10 Pa·s, and more preferably equal to or greater than 15 Pa·s, and is equal to or less than 3000 Pa·s, preferably equal to or less than 2800 Pa·s, and more preferably equal to or less than 2500 Pa·s. When the melt viscosity (190° C.) of the high melt viscosity nonionic resin (a-2) is equal to or greater than 5 Pa·s, the durability of the golf ball improves. When the melt viscosity (190° C.) of the high melt viscosity nonionic resin (a-2) is equal to or less than 3000 Pa·s, the moldability of the mid layer composition is excellent.

Examples of the high melt viscosity nonionic resin (a-2) include trade name "NUCREL" available from Du Pont-MITSUI POLYCHEMICALS Co., Ltd., and specific examples thereof include ethylene-methacrylic acid copolymers available as trade names "NUCREL N1050H", "NUCREL N2050H", "NUCREL AN4318", "NUCREL N1110H", "NUCREL N0200H", and the like. Another example of the high melt viscosity nonionic resin (a-2) is an ethylene-acrylic acid copolymer available from the Dow Chemical Company as trade name "PRIMACOR 5990I".

As the high melt viscosity resin (A), the high melt viscosity ionomer resin (a-1) or the high melt viscosity nonionic resin (a-2) may be used solely, or the ionomer resin (a-1) and the nonionic resin (a-2) may be used in combination. When the ionomer resin (a-1) and the nonionic resin (a-2) are used in combination, the weight ratio [(a-1)/(a-2)] of the ionomer resin (a-1) with respect to the nonionic resin (a-2) is preferably equal to or greater than 1/99, more preferably equal to or greater than 5/95, and even more preferably equal to or greater than 10/90, and is preferably equal to or less than 90/10, more preferably equal to or less than 80/20, and even more preferably equal to or less than 70/30. When the weight ratio is in the above preferable range, the moldability of the golf ball improves, and particularly, a thin mid layer can be easily molded.

The following will describe the low melt viscosity ionomer resin (B).

The low melt viscosity ionomer resin (B) is one or two types selected from the group consisting of a neutralized product (b-1) and a neutralized product (b-2).

The neutralized product (b-1) is a compound obtained by neutralizing at least some of carboxyl groups in a binary copolymer formed with ethylene and an α,β-unsaturated carboxylic acid having 3 to 8 carbon atoms, with metal ions.

The neutralized product (b-2) is a compound obtained by neutralizing at least some of carboxyl groups in a ternary copolymer formed with ethylene, an α,β-unsaturated carboxylic acid having 3 to 8 carbon atoms, and an α,β-unsaturated carboxylic acid ester, with metal ions.

The low melt viscosity ionomer resin (B) may be a mixture of the neutralized product (b-1) and the neutralized product (b-2).

The melt viscosity (190° C.), measured with the Brookfield viscometer, of the low melt viscosity ionomer resin (B) is equal to or greater than 1 Pa·s and equal to or less than 10 Pa·s.

The same α,β-unsaturated carboxylic acid as the α,β-unsaturated carboxylic acid that can be included in the ionomer resin (a-1) can be used as the α,β-unsaturated carboxylic acid, having 3 to 8 carbon atoms, which can be included in the low melt viscosity ionomer resin (B). In other words, the same α,β-unsaturated carboxylic acid as the α,β-unsaturated carboxylic acid that can be included in the ionomer resin (a-1) can be used as the α,β-unsaturated carboxylic acid, having 3 to 8 carbon atoms, which can be included in the neutralized product (b-1) or the neutralized product (b-2).

The same α,β-unsaturated carboxylic acid ester as the α,β-unsaturated carboxylic acid ester that can be included in the ionomer resin (a-1) can be used as the α,β-unsaturated carboxylic acid ester of the neutralized product (b-2).

Examples of metal ions used for neutralizing the neutralized product (b-1) or the neutralized product (b-2) include monovalent alkali metal ions such as sodium, potassium, and lithium; bivalent metal ions such as magnesium, calcium, zinc, barium, and cadmium; trivalent metal ions such as aluminum; and other ions such as tin and zirconium. Among them, bivalent metal ions such as magnesium, calcium, zinc, barium, and cadmium are preferred.

The melt viscosity (190° C.), measured with the Brookfield viscometer, of the low melt viscosity ionomer resin (B) is equal to or greater than 1 Pa·s, preferably equal to or greater than 2 Pa·s, and more preferably equal to or greater than 3 Pa·s, and is equal to or less than 10 Pa·s, preferably equal to or less than 9 Pa·s, and more preferably equal to or less than 8 Pa·s. When the melt viscosity (190° C.) of the low melt viscosity ionomer resin (B) is equal to greater than 1 Pa·s, the compatibility between the low melt viscosity ionomer resin (B) and the high melt viscosity resin (A) is enhanced, and the durability of the golf ball improves. When the melt viscosity (190° C.) of the low melt viscosity ionomer resin (B) is equal to less than 10 Pa·s, the effect of improving the fluidity of the mid layer composition is great.

The melt flow rate (measurement temperature: 190° C., load: 2.16 kg) of the low melt viscosity ionomer resin (B) is preferably equal to or greater than 100 g/10 min, more preferably equal to or greater than 150 g/10 min, and even more preferably equal to or greater than 200 g/10 min, and is preferably equal to or less than 2000 g/10 min, more preferably equal to or less than 1900 g/10 min, and even more preferably equal to or less than 1800 g/10 min. When the melt flow rate of the low melt viscosity ionomer resin (B) is equal to or greater than 100 g/10 min, the effect of improving the fluidity of the mid layer composition is greater. When the melt flow rate of the low melt viscosity ionomer resin (B) is equal to or less than 2000 g/10 min, the compatibility between the low melt viscosity ionomer resin (B) and the high melt viscosity resin (A) component is enhanced, and the durability of the golf ball improves more.

In the present specification, in measuring a melt flow rate (MFR), a flow tester (SHIMADZU Flow Tester CFT-100C, manufactured by SHIMADZU CORPORATION) is used. The measurement is conducted according to JIS K7210 under the conditions of: a measurement temperature of 190° C.; and a load of 2.16 kg.

The content of the α,β-unsaturated carboxylic acid component, having 3 to 8 carbon atoms, in the low melt viscosity ionomer resin (B) is preferably equal to or greater than 2% by weight and more preferably equal to or greater than 3% by weight, and is preferably equal to or less than 30% by weight and more preferably equal to or less than 20% by weight.

The degree of neutralization L1 of the carboxyl groups in the low melt viscosity ionomer resin (B) is preferably equal to or greater than 10 mol %, more preferably equal to or greater than 15 mol %, even more preferably equal to or greater than 20 mol %, and most preferably 100 mol %.

Where L2 (mole) denotes the number of moles of carboxyl group neutralized in the low melt viscosity ionomer resin (B) and T2 (mole) denotes the total number of moles of the carboxyl groups in the resin (B), the degree of neutralization L1 (mol %) can be calculated using the following formula.

$$L1=100*(L2/T2)$$

Specific examples of the low melt viscosity ionomer resin (B) include trade names "Aclyn 201 (Ca)", "Aclyn 246 (Mg)", and "Aclyn 295 (Zn)", available from Honeywell international Inc.

The ratio (weight ratio) A1/B1 of the high melt viscosity resin (A) with respect to the low melt viscosity ionomer resin (B) is not limited. Preferably, in light of resilience performance, the ratio A1/B1 is preferably equal to or greater than 55/45, more preferably equal to or greater than 58/42, and even more preferably equal to or greater than 60/40. In light of fluidity of resin, the ratio A1/B1 is preferably equal to or less than 99/1, more preferably equal to or less than 90/10, and even more preferably equal to or less than 85/15. The ratio A1/B1 in this preferable range can contribute to reduction of the mid layer in thickness and the resilience performance and the durability of the mid layer.

The following will describe the metal ion source (C1).

The metal ion source (C1) is a basic metal compound that can neutralize non-neutralized carboxyl groups in the high melt viscosity resin (A) and the low melt viscosity ionomer resin (B). The metal ion source (C1) is not included in the resin component of the mid layer composition.

Examples of the metal ion source (C1) include metal hydroxides such as magnesium hydroxide, calcium hydroxide, sodium hydroxide, lithium hydroxide, potassium hydroxide, and copper hydroxide; metal oxides such as magnesium oxide calcium oxide, zinc oxide, and copper oxide; and metal carbonates such as magnesium carbonate, calcium carbonate, sodium carbonate, lithium carbonate, and potassium carbonate. One of these metal ion sources (C1) may be used solely, or two or more of these metal ion sources (C1) may be used in combination. Among them, as the metal ion source (C1), metal hydroxides are preferred, and magnesium hydroxide and calcium hydroxide are particularly suitable.

The amount of the metal ion source (C1) is equal to or greater than 0.1 part by weight, preferably equal to or greater than 0.2 part by weight, and more preferably equal to or greater than 0.3 part by weight, and is equal to or less than 10 parts by weight, preferably equal to or less than 9 parts by weight, and more preferably equal to or less than 8 parts by weight, per total 100 parts by weight of the high melt viscosity resin (A) and the low melt viscosity ionomer resin (B). When the amount of the metal ion source (C1) is in the above range, the resilience performance of the golf ball improves, and the moldability of the mid layer improves.

Preferably, the amount of the metal ion source (C1) is adjusted such that the degree of neutralization of all carboxyl groups included in the resin (A) and the resin (B) is equal to or greater than 50 mol %. More preferably, the amount of the metal ion source (C1) is adjusted such that the degree of neutralization of all the carboxyl groups included in the resin (A) and the resin (B) is equal to or greater than 75 mol %. Even more preferably, the amount of the metal ion source (C1) is adjusted such that the degree of neutralization of all the carboxyl groups included in the resin (A) and the resin (B) is equal to or greater than 80 mol %.

The resin component of the mid layer composition preferably includes only the high melt viscosity resin (A) and the low melt viscosity ionomer resin (B), but may include a thermoplastic resin and/or a thermosetting resin (hereinafter, referred to merely as resin (D)) in addition to the resin (A) and the resin (B) as long as it does not impair the effects of the present invention.

In this case, the amount of the resin (D) is preferably greater than 0 part by weight, more preferably equal to or greater than 1 part by weight and even more preferably equal to or greater than 5 parts by weight, and is preferably equal to or less than 100 parts by weight, more preferably equal to or less than 70 parts by weight, and even more preferably equal to or less than 50 parts by weight, per total 100 parts by weight of the high melt viscosity resin (A) and the low melt viscosity ionomer resin (B). When the amount of the resin (D) is in the above range, desired properties, such as hardness and resilience characteristics, of the mid layer composition are easily obtained.

Examples of the resin (D) include thermoplastic resins including: thermoplastic polyamide elastomers available from Arkema Inc. as trade name "Pebax (e.g. "Pebax 2533")"; thermoplastic polyester elastomers available from Du Pont-Toray Co., Ltd. as trade name "Hytrel (e.g. "Hytrel 3548" and "Hytrel 4047")"; thermoplastic polystyrene elastomers available from Mitsubishi Chemical Corporation as trade name "Rabalon" or thermoplastic polyester elastomers available from Mitsubishi Chemical Corporation as trade name "Primalloy"; and a thermoplastic polyurethane elastomers available from BASF polyurethane elastomers Ltd as a trade name "Elastollan (e.g. "Elastollan ET880")". Other examples of the resin (D) include thermosetting resins including: resins obtained by crosslinking a rubber composition with sulfur, an organic peroxide, or the like; thermosetting polyurethane resins; epoxy resins; and phenolic resins. The resin (D) may be a mixture of a thermoplastic resin and a thermosetting resin.

A more preferable resin (D) is a thermoplastic resin. In light of resilience performance, the amount of the thermoplastic resin (D) is preferably equal to or greater than 1 part by weight, more preferably equal to or greater than 10 parts by weight, and more preferably equal to or greater than 20 parts by weight, per total 100 parts by weight of the high melt viscosity resin (A) and the low melt viscosity ionomer resin (B). In light of high fluidity, the amount of the thermoplastic resin (D) is preferably equal to or less than 95 parts by weight, more preferably equal to or less than 90 parts by weight, and more preferably equal to or less than 80 parts by weight, per total 100 parts by weight of the high melt viscosity resin (A) and the low melt viscosity ionomer resin (B).

Examples of the thermoplastic resin (D) include styrene elastomers, polyurethane elastomers, polyamide elastomers, and mixtures thereof. Specific examples of the thermoplastic resin (D) include thermoplastic polyamide elastomers available from Arkema Inc. as trade name "Pebax (e.g. "Pebax 2533")"; thermoplastic polyester elastomers available from Du Pont-Toray Co., Ltd. as trade name "Hytrel (e.g. "Hytrel 3548", "Hytrel 4047")"; thermoplastic polystyrene elastomers available from Mitsubishi Chemical Corporation as trade name "Rabalon" or thermoplastic polyester elastomers available from Mitsubishi Chemical Corporation as trade name "Primalloy"; and thermoplastic polyurethane elastomers available from BASF polyurethane elastomers Ltd as trade name "Elastollan (e.g. "Elastollan ET880")".

Examples of the above "Rabalon" include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", available from Mitsubishi Chemical Corporation.

Low-molecular materials such as aliphatic acids are not used for the mid layer 6. In the golf ball 2, deterioration of adhesion between the mid layer 6 and the adjacent layers, which is caused due to aliphatic acids and the like, does not occur.

From the standpoint that a thin mid layer 6 is easily formed due to high fluidity, the mid layer 6 has a melt flow rate of 4 g/10 min or greater, more preferably 7 g/10 min or greater, and even more preferably 10 g/10 min or greater. The melt flow rate is preferably equal to or less than 40 g/10 min.

For measuring the melt flow rate (MFR) of the mid layer 6, the composition of the mid layer is used. The measurement is conducted using a flow tester (SHIMADZU Flow Tester CFT-100C, manufactured by SHIMADZU CORPORATION) according to JIS K7210 under the conditions of: a measurement temperature of 190° C.; and a load of 2.16 kg.

The reason why the melt viscosity (190° C.) of the high melt viscosity resin (A) is regulated as a value measured with the flow tester and the melt viscosity (190° C.) of the low melt viscosity ionomer resin (B) is regulated as a value measured with the Brookfield viscometer, is that a measurement method suitable for measuring the range of the melt viscosity (190° C.) of each resin is used. These measurement methods are as follows.

[Melt Viscosity Measured with Flow Tester]

For this measurement, a sample in the form of a pellet is prepared. The sample in the form of a pellet is subjected to measurement using a flow characteristics evaluation apparatus (Flow Tester CFT-500D, manufactured by SHIMADZU CORPORATION) under the following conditions.

Measurement Conditions

DIE LENGTH: 1 mm

DIE DIA: 1 mm

Load: 294 N

Temperature: 190° C.

[Melt Viscosity Measured with Brookfield Viscometer]

Using a Brookfield viscometer (BL viscometer, manufactured by TOKYO KEIKI INC.), a sample (resin (B)) is heated to 190° C. and subjected to measurement. As the measurement conditions, a rotor No. 4 is used, and the rotational speed is 6 rpm.

Measurement values of melt viscosities (190° C.) of some of the aforementioned ionomer resins (a-1), nonionic resins (a-2), and low melt viscosity ionomer resins (B) are shown below.

The aforementioned "Himilan 1555" has a melt viscosity (190° C.), measured with the flow tester, of 540 Pa·s, and a melt flow rate (190° C., 2.16 kg) of 10 g/10 min.

The aforementioned "Surlyn 8150" has a melt viscosity (190° C.), measured with the flow tester, of 1200 Pa·s, and a melt flow rate (190° C., 2.16 kg) of 4.5 g/10 min.

The aforementioned "Himilan AM7329" has a melt viscosity (190° C.), measured with the flow tester, of 1100 Pa·s, and a melt flow rate (190° C., 2.16 kg) of 5 g/10 min.

The aforementioned "Surlyn 9150" has a melt viscosity (190° C.), measured with the flow tester, of 1200 Pa·s, and a melt flow rate (190° C., 2.16 kg) of 4.5 g/10 min.

The aforementioned "Surlyn 6320" has a melt viscosity (190° C.), measured with the flow tester, of 4700 Pa·s, and a melt flow rate (190° C., 2.16 kg) of 1.1 g/10 min.

The aforementioned "Himilan 1702" has a melt viscosity (190° C.), measured with the flow tester, of 540 Pa·s, and a melt flow rate (190° C., 2.16 kg) of 10 g/10 min.

The aforementioned "NUCREL N1050H" has a melt viscosity (190° C.), measured with the flow tester, of 6 Pa·s, and a melt flow rate (190° C., 2.16 kg) of 500 g/10 min.

The aforementioned "NUCREL N2050H" has a melt viscosity (190° C.), measured with the flow tester, of 8 Pa·s, and a melt flow rate (190° C., 2.16 kg) of 500 g/10 min.

The aforementioned "NUCREL AN4318" has a melt viscosity (190° C.), measured with the flow tester, of 160 Pa·s, and a melt flow rate (190° C., 2.16 kg) of 30 g/10 min.

The aforementioned "Aclyn 201" has a melt viscosity (190° C.), measured with the flow tester, of 5.5 Pa·s, and a melt flow rate (190° C., 2.16 kg) of 185 g/10 min.

The aforementioned "Aclyn 295" has a melt viscosity (190° C.), measured with the flow tester, of 4.5 Pa·s, and a melt flow rate (190° C., 2.16 kg) of 1200 g/10 min.

In light of resilience performance, the mid layer 6 has a hardness H2 of preferably 62 or greater, more preferably 66 or greater, and particularly preferably 70 or greater. In light of feel at impact, the hardness H2 of the mid layer 6 is preferably equal to or less than 86, more preferably equal to or less than 85, and particularly preferably equal to or less than 82. For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the mid layer 6 is used for the measurement. The hardness H2 is measured by pressing a JIS-C type hardness scale against the slab. For the measurement, an automated rubber hardness measurement machine (trade name "P1", available from Kobunshi Keiki Co., Ltd.), to which this hardness scale is mounted, is used.

The mid layer 6 has a specific gravity G2 of preferably 1.10 or greater. Due to the mid layer 6, the weight distribution of the golf ball 2 can be biased such that the weight is greater on the outer side than on the inner side. Due to this bias, the moment of inertia of the golf ball 2 increases. Due to this bias, spin is suppressed. In these respects, the specific gravity G2 is more preferably equal to or greater than 1.15 and particularly preferably equal to or greater than 1.20. A great specific gravity G2 can be accomplished by including a filler with a high specific gravity. This filler decreases the resilience performance. In light of resilience performance, the specific gravity G2 is preferably equal to or less than 1.50, more preferably equal to or less than 1.45, and particularly preferably equal to or less than 1.40.

In order to accomplish the above preferable specific gravity G2, a filler with a high specific gravity may be included in the mid layer 6. A typical filler with a high specific gravity is powder of a metal with a high specific gravity. Typical metals with a high specific gravity are tungsten and molybdenum. In light of versatility, tungsten is preferred. The amount of powder of a metal with a high specific gravity is preferably adjusted such that the above preferable specific gravity G2 is accomplished.

When a filler with a high specific gravity is included, in light of suppression of spin, the amount of the filler with a high specific gravity is preferably equal to or greater than 20 parts by weight, more preferably equal to or greater than 25 parts by weight, and particularly preferably equal to or greater than 28 parts by weight, per 100 parts by weight of the base polymer of the mid layer 6. In light of ease of forming the mid layer 6, the amount of the filler is preferably equal to or less than 50 parts by weight and more preferably equal to or less than 40 parts by weight.

In light of durability of the golf ball 2, the mid layer 6 has a thickness of preferably 0.5 mm or greater, more preferably 0.6 mm or greater, and particularly preferably 0.7 mm or greater. From the standpoint that the core 4 with a sufficient diameter can be formed, the thickness of the mid layer 6 is preferably equal to or less than 1.6 mm, more preferably equal to or less than 1.2 mm, and particularly preferably equal to or less than 1.0 mm.

From the standpoint that the core 4 with a sufficient diameter can be formed, the mid layer 6 has an outer diameter of preferably 40.7 mm or greater, more preferably 40.9 mm or greater, and particularly preferably 41.2 mm or greater. The outer diameter of the mid layer 6 is preferably equal to or less than 42.2 mm.

A resin composition is suitably used for the cover 8. Examples of the base polymer of this resin composition include ionomer resins, styrene block-containing thermoplastic elastomers, thermoplastic polyester elastomers, thermoplastic polyamide elastomers, and thermoplastic polyolefin elastomers. Particularly, ionomer resins are preferred. Ionomer resins are highly elastic. The golf ball 2 with the cover 8 including an ionomer resin has excellent resilience performance. The ionomer resins described above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. This binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. This ternary copolymer has excellent resilience performance. For the binary copolymer and ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320", and "Himilan MK7329", available from Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", available from E.I. du Pont de Nemours and Company; and trade names "IOTEK 7010", "IOTEK 7030", "IOTEK 7510", "IOTEK 7520", "IOTEK 8000", and "IOTEK 8030", available from ExxonMobil Chemical Corporation.

Two or more types of ionomer resins may be used in combination for the cover 8. An ionomer resin neutralized with a monovalent metal ion, and an ionomer resin neutralized with a bivalent metal ion may be used in combination.

An example of a resin that can be used in combination with an ionomer resin is a styrene block-containing thermoplastic elastomer. This elastomer can contribute to the feel at impact of the golf ball 2. This elastomer does not impair the resilience performance of the golf ball 2. This elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present specification, styrene block-containing thermoplastic elastomers include alloys of olefin and one or more types selected from the group consisting of SBS, SIS, SIBS, SEBS, SEPS, SEEPS, and hydrogenated products thereof. An olefin component in the alloy is presumed to contribute to improvement of compatibility with ionomer resins. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C" "Rabalon SJ4400N", "Rabalon SJ5400N", "Rabalon SJ6400N", "Rabalon SJ7400N", "Rabalon SJ8400N", "Rabalon SJ9400N", and "Rabalon SR04", available from Mitsubishi Chemical Corporation. Other specific examples of styrene block-containing thermoplastic elastomers include trade name "Epofriend A1010" available from Daicel Chemical Industries, Ltd., and trade name "Septon HG-252" available from Kuraray Co., Ltd.

When an ionomer resin and a styrene block-containing thermoplastic elastomer are used in combination for the cover 8, the weight ratio of them is preferably equal to or greater than 60/40. The cover 8 with a weight ratio of 60/40 or greater contributes to the resilience performance of the golf ball 2. In this respect, the ratio is more preferably equal to or greater than 75/25 and particularly preferably equal to or greater than 85/15. In light of feel at impact, the ratio is preferably equal to or less than 98/2. This weight ratio is the ratio of the weight of the ionomer resin with respect to the weight of the styrene block-containing thermoplastic elastomer.

An ionomer resin and the high melt viscosity nonionic resin (a-2) may be used in combination for the cover 8. Use of the nonionic resin (a-2) can contribute to improvement of the moldability and the durability. In light of moldability, the blend ratio (weight ratio) of the nonionic resin (a-2) with respect to the ionomer resin is preferably equal to or greater than 10/90 and more preferably equal to or greater than 20/80. In light of resilience performance, the weight ratio is preferably equal to or less than 40/60.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 8 in an adequate amount. For forming the cover 8, known methods such as injection molding, compression molding, and the like can be used. When forming the cover 8, the dimples 14 are formed by pimples formed on the cavity face of a mold.

In light of suppression of spin, the cover 8 has a hardness H3 of preferably 85 or greater, more preferably 87 or greater, and particularly preferably 89 or greater. In light of feel at impact, the hardness H3 of the cover 8 is preferably equal to or less than 98, more preferably equal to or less than 97, and particularly preferably equal to or less than 96. For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the cover 8 is used for the measurement. The hardness H3 is measured by pressing a JIS-C type hardness scale against the slab. For the measurement, an automated rubber hardness measurement machine (trade name "P1", available from Kobunshi Keiki Co., Ltd.), to which this hardness scale is mounted, is used.

In light of ease of forming the cover 8, the cover 8 has a thickness of preferably 0.3 mm or greater, more preferably 0.5 mm or greater, and particularly preferably 0.7 mm or greater. The core 4 with a large outer diameter contributes to resilience performance. In light of outer diameter of the core 4, the thickness of the cover 8 is preferably equal to or less than 1.6 mm, more preferably equal to or less than 1.2 mm, and particularly preferably equal to or less than 1.0 mm.

In light of achievement of an outer-hard/inner-soft structure, the hardness H2 of the mid layer 6 is preferably less than the hardness H3 of the cover 8. In this respect, the difference (H3−H2) is preferably equal to or greater than 3, more preferably equal to or greater than 5, and even more preferably equal to or greater than 10. In light of feel at impact, the difference (H3−H2) is preferably equal to or less than 20 and more preferably equal to or less than 15.

In light of achievement of an outer-hard/inner-soft structure, the difference (H3−H1) between the hardness H3 of the cover 8 and the central hardness H1 of the center 10 is preferably equal to or greater than 45, more preferably equal to or greater than 50, even more preferably equal to or greater than 55, and particularly preferably equal to or greater than 60. In light of feel at impact, the difference (H3−H1) is preferably equal to or less than 80 and more preferably equal to or less than 70.

In light of feel at impact, the amount of compressive deformation of the golf ball 2 is preferably equal to or greater than 2.5 mm, more preferably equal to or greater than 2.7 mm, and particularly preferably equal to or greater than 2.9 mm. In light of resilience performance, the amount of compressive deformation is preferably equal to or less than 4.0 mm, more preferably equal to or less than 3.8 mm, and particularly preferably equal to or less than 3.5 mm.

The following will describe a second embodiment.

Figure 2:
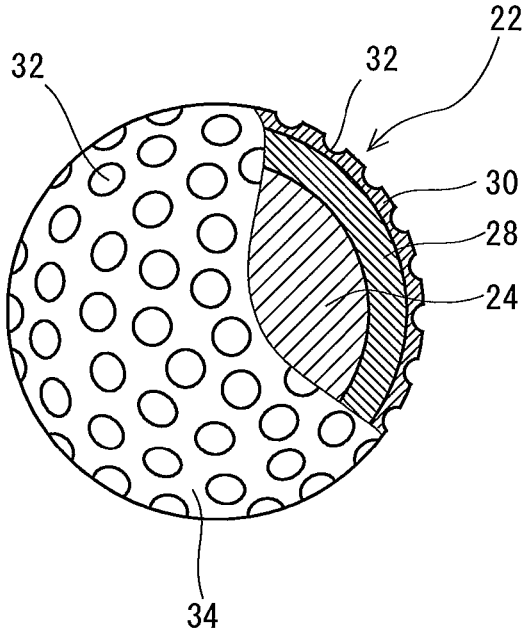
FIG. 2 is a schematic cross-sectional view of a golf ball according to a second embodiment of the present invention.

FIG. 2 is a partially cutaway plan view of a golf ball 22 according to the second embodiment of the present invention. The golf ball 22 includes a spherical core 24, a mid layer 28 positioned outside the core 24, and a cover 30 positioned outside the mid layer 28.

On the surface of the cover 30, a large number of dimples 32 are formed. Of the surface of the golf ball 22, a part other than the dimples 32 is a land 34. The golf ball 22 includes a paint layer and a mark layer on the external side of the cover 30 although these layers are not shown in the drawing.

The golf ball 22 has a diameter of 40 mm or greater and 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 22 has a weight of 40 g or greater and 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

The base material of the core 24 is a thermosetting polymer or a thermoplastic polymer. Preferably, the core is obtained by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferred. When another rubber is used in combination with a polybutadiene, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

The rubber composition of the core 24 includes a co-crosslinking agent. The co-crosslinking agent achieves high resilience of the core 24. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 22, the amount of the co-crosslinking agent is preferably equal to or greater than 10 parts by weight and more preferably equal to or greater than 15 parts by weight, per 100 parts by weight of the base rubber. In light of soft feel at impact, the amount of the co-crosslinking agent is preferably equal to or less than 50 parts by weight and more preferably equal to or less than 45 parts by weight, per 100 parts by weight of the base rubber.

Preferably, the rubber composition of the core 24 includes an organic peroxide together with a co-crosslinking agent. The organic peroxide serves as a crosslinking initiator. The organic peroxide contributes to the resilience performance of the golf ball 22. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance of the golf ball 22, the amount of the organic peroxide is preferably equal to or greater than 0.1 part by weight, more preferably equal to or greater than 0.3 part by weight, and particularly preferably equal to or greater than 0.5 part by weight, per 100 parts by weight of the base rubber. In light of soft feel at impact, the amount of the organic peroxide is preferably equal to or less than 3.0 parts by weight, more preferably equal to or less than 2.8 parts by weight, and particularly preferably equal to or less than 2.5 parts by weight, per 100 parts by weight of the base rubber.

Preferably, the rubber composition of the core 24 includes an organic sulfur compound. Preferable organic sulfur compounds are the same as the preferable organic sulfur compounds for the rubber composition of the above center 10. The organic sulfur compound contributes to resilience performance. Particularly preferable organic sulfur compounds are diphenyl disulfide and bis(pentabromophenyl)disulfide.

In light of resilience performance of the golf ball 22, the amount of the organic sulfur compound is preferably equal to or greater than 0.1 part by weight and more preferably equal to or greater than 0.2 part by weight, per 100 parts by weight of the base rubber. In light of soft feel at impact, the amount of the organic sulfur compound is preferably equal to or less than 1.5 parts by weight, more preferably equal to or less than 1.0 part by weight, and particularly preferably equal to or less than 0.8 part by weight, per 100 parts by weight of the base rubber.

For the purpose of adjusting specific gravity and the like, a filler may be included in the core 24. Examples of suitable fillers include zinc oxide, barium sulfate, calcium carbonate, and magnesium carbonate. The amount of the filler is determined as appropriate so that the intended specific gravity of the core 24 is accomplished. A particularly preferable filler is zinc oxide. Zinc oxide serves not only as a specific gravity adjuster but also as a crosslinking activator. According to need, various additives such as an anti-aging agent, a coloring agent, a plasticizer, a dispersant, and the like are included in the core 24 in an adequate amount. Crosslinked rubber powder or synthetic resin powder may be also included in the core 24.

In light of durability, the core 24 has a central hardness H1*c* of preferably 25 or greater, more preferably 30 or greater, and particularly preferably 35 or greater. In light of suppression of spin, the central hardness H1*c* is preferably equal to or less than 55, more preferably equal to or less than 50, and particularly preferably equal to or less than 45. The central hardness H1*c* is measured by pressing a Shore D type hardness scale against the central point of a cut plane of the core 24 that has been cut into two halves. For the measurement, an automated rubber hardness measurement machine (trade name "P1", available from Kobunshi Keiki Co., Ltd.), to which this hardness scale is mounted, is used.

In light of resilience performance, the core 24 has a surface hardness H1*s* of preferably 35 or greater, more preferably 40 or greater, and particularly preferably 45 or greater. In light of feel at impact, the surface hardness H1*s* is preferably equal to or less than 65, more preferably equal to or less than 60, and particularly preferably equal to or less than 55. The surface hardness H1*s* is measured by pressing a Shore D type hardness scale against the surface of the core 24. For the measurement, an automated rubber hardness measurement machine (trade name "P1", available from Kobunshi Keiki Co., Ltd.), to which this hardness scale is mounted, is used.

In light of suppression of spin, the difference (H1*s*–H1*c*) between the surface hardness H1*s* and the central hardness H1*c* is preferably equal to or greater than 10, more preferably equal to or greater than 13, and particularly preferably equal to or greater than 20. In light of durability of the golf ball 22, the difference (H1*s*–H1*c*) is preferably equal to or less than 30, more preferably equal to or less than 27, and particularly preferably equal to or less than 25.

The core 24 has a specific gravity G1 of preferably 1.18 or less. Due to the core 24, the weight distribution of the golf ball 22 can be biased such that the weight is greater on the outer side than on the inner side. Due to this bias, spin is suppressed. In this respect, the specific gravity G1 is more preferably equal to or less than 1.14 and particularly preferably equal to or less than 1.09. The specific gravity G1 is preferably equal to or greater than 1.00.

In light of feel at impact, the core 24 has the amount of compressive deformation of preferably 3.3 mm or greater, more preferably 3.5 mm or greater, and particularly preferably 3.8 mm or greater. In light of resilience performance, the amount of compressive deformation is preferably equal to or less than 7.0 mm, more preferably equal to or less than 5.0 mm, and particularly preferably equal to or less than 4.5 mm.

Upon measurement of the amount of compressive deformation, first, a sphere (the core 24 or the golf ball 22) is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load of 98 N is applied to the sphere up to the state in which a final load of 1274 N is applied thereto, is the amount of compressive deformation.

In light of resilience performance, the core 24 has a diameter of preferably 38.0 mm or greater, more preferably 38.5 mm or greater, and particularly preferably 39.0 mm or greater. From the standpoint that the mid layer 28 with a sufficient thickness can be formed, the diameter is preferably equal to or less than 41 mm.

The core 24 has a weight W1 of preferably 32 g or greater and 39 g or less. The temperature for crosslinking the core 24 is generally equal to or higher than 140° C. and equal to or lower than 180° C. The time period for crosslinking the core 24 is generally equal to or longer than 10 minutes and equal to or shorter than 60 minutes. The core 24 may be formed with two or more layers. The core 24 may have a rib on the surface thereof.

The mid layer 28 includes a composition (M) that is formed from a high melt viscosity resin (A), a low melt viscosity ionomer resin (B), and a metal ion source (C1). The composition (M) may include a compound in addition to the resin (A), the resin (B), and the metal ion source (C1).

In light of enhancement of an effect caused by the composition (M), the proportion of the composition (M) in the mid layer 28 is preferably equal to or greater than 50% by weight, more preferably equal to or greater than % by weight, and even more preferably equal to or greater than 70% by weight. This proportion may be 100% by weight.

In the composition (M), how much extent the metal ion source (C1) neutralizes the resin (A) and the resin (B) is not limited. At least a part of a later-described resin (a-2) may be neutralized by the metal ion source (C1). All carboxyl groups in the resin (a-2) may be neutralized by the metal ion source (C1). The resin (a-2) may not be neutralized by the metal ion source (C1).

Any weight ratios that are described in the present specification are blend ratios of materials. Due to chemical reactions of materials, weight ratios in the golf ball 22 may be different from blend ratios of the materials.

The high melt viscosity resin (A) is an ionomer resin (a-1), the nonionic resin (a-2), or a mixture of the resin (a-1) and the resin (a-2).

The low melt viscosity ionomer resin (B) is at least one or more types selected from two types of: a metal ion neutralized product (b-1) of a binary copolymer formed with ethylene and an α,β-unsaturated carboxylic acid having 3 to 8 carbon atoms; and a metal ion neutralized product (b-2) of a ternary copolymer formed with ethylene, an α,β-unsaturated carboxylic acid having 3 to 8 carbon atoms, and an α,β-unsaturated carboxylic acid ester. The low melt viscosity ionomer resin (B) has a melt viscosity (190° C.), measured with a Brookfield viscometer, of 1 Pa·s or greater and 10 Pa·s or less.

The metal ion source (C1) is a compound that can neutralize carboxyl groups in the high melt viscosity resin (A) and the low melt viscosity ionomer resin (B).

First, the ionomer resin (a-1) that can be used as the high melt viscosity resin (A) will be described.

The ionomer resin (a-1) is one or two types selected from the group consisting of a neutralized product (a-11) and a neutralized product (a-12).

The neutralized product (a-11) is a compound obtained by neutralizing at least some of carboxyl groups in a binary copolymer formed with ethylene and an α,β-unsaturated carboxylic acid having 3 to 8 carbon atoms, with metal ions.

The neutralized product (a-12) is a compound obtained by neutralizing at least some of carboxyl groups in a ternary copolymer formed with ethylene, an α,β-unsaturated carboxylic acid having 3 to 8 carbon atoms, and an α,β-unsaturated carboxylic acid ester, with metal ions.

The ionomer resin (a-1) may be a mixture of the neutralized product (a-11) and the neutralized product (a-12).

The ionomer resin (a-1) has a melt viscosity (190° C.), measured with a flow tester, of 500 Pa·s or greater and 100000 Pa·s or less.

Examples of the α,β-unsaturated carboxylic acid having 3 to 8 carbon atoms include acrylic acid, methacrylic acid, fumaric acid, maleic acid, and crotonic acid. Particularly, acrylic acid and methacrylic acid are preferred.

Examples of the α,β-unsaturated carboxylic acid ester include methyl esters of acrylic acid, methacrylic acid, fumaric acid, maleic acid, and the like; ethyl esters of acrylic acid, methacrylic acid, fumaric acid, maleic acid, and the like; propyl esters of acrylic acid, methacrylic acid, fumaric acid, maleic acid, and the like; n-butyl esters of acrylic acid, methacrylic acid, fumaric acid, maleic acid, and the like; and isobutyl esters of acrylic acid, methacrylic acid, fumaric acid, maleic acid, and the like. Particularly, acrylic acid esters and methacrylic acid esters are preferred. The carbon number of the α,β-unsaturated carboxylic acid that is the material for the α,β-unsaturated carboxylic acid ester is preferably equal to or greater than 3 and equal to or less than 8.

Examples of metal ions for neutralizing at least some of the carboxyl groups in the neutralized product (a-11) and the neutralized product (a-12) include monovalent alkali metal ions such as sodium, potassium, and lithium; bivalent metal ions such as magnesium, calcium, zinc, barium, and cadmium; trivalent metal ions such as aluminum; and other ions such as tin and zirconium. Bivalent metal ions such as magnesium, calcium, zinc, barium, and cadmium are preferred, and zinc and magnesium are more preferred. When a bivalent metal ion is used, the durability and the low-temperature durability of the resultant golf ball improve. Thus, bivalent metal ions are preferred.

Preferably, the ionomer resin (a-1) is: a compound obtained by neutralizing at least some of carboxyl groups in a binary copolymer formed with ethylene and (meth)acrylic acid, with metal ions; a compound obtained by neutralizing at least some of carboxyl groups in a ternary copolymer formed with ethylene, (meth)acrylic acid, and a (meth)acrylic acid ester, with metal ions; or a mixture thereof. In the present specification, (meth)acrylic acid indicates acrylic acid and/or methacrylic acid.

One example of a more preferable high melt viscosity ionomer resin (a-1) is a mixture (M1) of the following compound (a-1-1) and compound (a-1-2):

(a-1-1) a compound obtained by neutralizing at least some of carboxyl groups in a binary copolymer formed with ethylene and (meth)acrylic acid, with monovalent metal ions, or a compound obtained by neutralizing at least some of carboxyl groups in a ternary copolymer formed with ethylene, (meth) acrylic acid, and a (meth)acrylic acid ester, with monovalent metal ions; and (a-1-2) a compound obtained by neutralizing at least some of carboxyl groups in a binary copolymer formed with ethylene and (meth)acrylic acid, with bivalent metal ions, or a compound obtained by neutralizing at least some of carboxyl groups in a ternary copolymer formed with ethylene, (meth) acrylic acid, and a (meth)acrylic acid ester, with bivalent metal ions.

Use of the aforementioned ionomer resin mixture (M1) can improve the rebound resilience of the mid layer composition. As the monovalent metal ions, sodium, lithium, potassium, rubidium, cesium, and francium are preferred. As the bivalent metal ions, magnesium, calcium, zinc, beryllium, strontium, barium, and radium are preferred. The ratio (weight ratio) of the compound (a-1-1) with respect to the compound (a-1-2), namely, the weight ratio [(a-1-1)/(a-1-2)], is preferably equal to or greater than 0/100, more preferably equal to or greater than 25/75, and even more preferably equal to or greater than 30/70, and is preferably equal to or less than 80/20, more preferably equal to or less than 77/23, and even more preferably equal to or less than 75/25.

The content of the α,β-unsaturated carboxylic acid component, having 3 to 8 carbon atoms, in the ionomer resin (a-1) is preferably equal to or greater than 2% by weight and more preferably equal to or greater than 3% by weight, and is preferably equal to or less than 30% by weight and more preferably equal to or less than 25% by weight.

The degree of neutralization N1 of the carboxyl groups in the ionomer resin (a-1) is preferably equal to or greater than 20 mol % and more preferably equal to or greater than 30 mol %, and is preferably equal to or less than 90 mol % and more preferably equal to or less than 85 mol %. When the degree of neutralization N1 is equal to or greater than 20 mol %, the resilience and the durability of the golf ball are excellent. When the degree of neutralization N1 is equal to or less than 90 mol %, the fluidity of the mid layer composition is excellent and hence the moldability thereof is excellent.

Where N2 (mole) denotes the number of moles of carboxyl groups neutralized in the high melt viscosity ionomer resin (a-1) and T1 (mole) denotes the total number of moles of the carboxyl groups in the ionomer resin (a-1), the degree of neutralization N1 (mol %) of the ionomer resin (a-1) can be calculated using the following formula.

$$N1=100*(N2/T1)$$

The melt viscosity (190° C.), measured with the flow tester, of the high melt viscosity ionomer resin (a-1) is equal to or greater than 500 Pa·s, preferably equal to or greater than 1000 Pa·s, and more preferably equal to or greater than 1500 Pa·s, and is equal to or less than 100000 Pa·s, preferably equal to or less than 95000 Pa·s, and more preferably equal to or less than 92000 Pa·s. When the melt viscosity (190° C.) of the ionomer resin (a-1) is equal to or greater than 500 Pa·s, the durability of the golf ball improves. When the melt viscosity (190° C.) of the ionomer resin (a-1) is equal to or less than 100000 Pa·s, the moldability of the mid layer becomes excellent.

Examples of the high melt viscosity ionomer resin (a-1) include trade name "Himilan" available from Du Pont-MITSUI POLYCHEMICALS Co., Ltd. Specific examples of "Himilan" that can be used as the resin (a-1) are as described above.

Examples of the high melt viscosity ionomer resin (a-1) available from E.I. du Pont de Nemours and Company include trade name "Surlyn". Specific examples of "Surlyn" that can be used as the resin (a-1) are as described above. Specific examples of the ternary copolymer ionomer resin (the neutralized product (a-12)) include "Surlyn 6320 (Mg)", "Surlyn 8120 (Na)", "Surlyn 8320 (Na)", "Surlyn 9320 (Zn)", and "Surlyn 9320W (Zn)", and further include trade name "HPF 1000 (Mg)" and trade name "HPF 2000 (Mg)".

Examples of the high melt viscosity ionomer resin (a-1) available from ExxonMobil Chemical Corporation include trade name "Iotek". Specific examples of "Iotek" are as described above. Specific examples of the ternary copolymer ionomer resin (the neutralized product (a-12)) include trade name "Iotek 7510 (Zn)", and trade name "Iotek 7520 (Zn)". It is noted that Na, Zn, Li, and Mg described in the parentheses after the trade names indicate metal types of neutralizing metal ions.

The following will describe the high melt viscosity nonionic resin (a-2) that can be used as the high melt viscosity resin (A) of the resin component.

The high melt viscosity nonionic resin (a-2) is one or two types selected from the group consisting of a binary copolymer (a-21) and a ternary copolymer (a-22).

The binary copolymer (a-21) is a binary copolymer formed with ethylene and an α,β-unsaturated carboxylic acid having 3 to 8 carbon atoms. In the binary copolymer (a-21), the carboxyl groups are not neutralized.

The ternary copolymer (a-22) is a ternary copolymer formed with ethylene, an α,β-unsaturated carboxylic acid having 3 to 8 carbon atoms, and an α,β-unsaturated carboxylic acid ester. In the ternary copolymer (a-22), the carboxyl groups are not neutralized.

The high melt viscosity nonionic resin (a-2) may be a mixture of the binary copolymer (a-21) and the ternary copolymer (a-22).

The high melt viscosity nonionic resin (a-2) has a melt viscosity (190° C.), measured with a flow tester, of 5 Pa·s or greater and 3000 Pa·s or less.

The same α,β-unsaturated carboxylic acid as used in the ionomer resin (a-1) can be used as the α,β-unsaturated carboxylic acid having 3 to 8 carbon atoms and used in the binary copolymer (a-21) or the ternary copolymer (a-22).

As the high melt viscosity nonionic resin (a-2), a binary copolymer formed with ethylene and (meth)acrylic acid; a ternary copolymer formed with ethylene, (meth)acrylic acid, and an (meth)acrylic acid ester; or a mixture thereof, is preferably used.

The content of the α,β-unsaturated carboxylic acid, having 3 to 8 carbon atoms, in the high melt viscosity nonionic resin (a-2) is preferably equal to or greater than 2% by weight and more preferably equal to or greater than 3% by weight, and is preferably equal to or less than 30% by weight and more preferably equal to or less than 25% by weight.

The melt viscosity (190° C.), measured with the flow tester, of the high melt viscosity nonionic resin (a-2) is equal to or greater than 5 Pa·s, preferably equal to or greater than 10 Pa·s, and more preferably equal to or greater than 15 Pa·s, and is equal to or less than 3000 Pa·s, preferably equal to or less than 2800 Pa·s, and more preferably equal to or less than 2500 Pa·s. When the melt viscosity (190° C.) of the high melt viscosity nonionic resin (a-2) is equal to or greater than 5 Pa·s, the durability of the golf ball improves. When the melt viscosity (190° C.) of the high melt viscosity nonionic resin (a-2) is equal to or less than 3000 Pa·s, the moldability of the mid layer composition is excellent.

Examples of the high melt viscosity nonionic resin (a-2) include trade name "NUCREL" available from Du Pont-MITSUI POLYCHEMICALS Co., Ltd., and specific examples thereof include ethylene-methacrylic acid copolymers available as trade names "NUCREL N1050H", "NUCREL N2050H", "NUCREL AN4318", "NUCREL N1110H", "NUCREL N0200H", and the like. Another example of the high melt viscosity nonionic resin (a-2) is an ethylene-acrylic acid copolymer available from the Dow Chemical Company as trade name "PRIMACOR 5990I".

As the high melt viscosity resin (A), the high melt viscosity ionomer resin (a-1) or the high melt viscosity nonionic resin (a-2) may be used solely, or the ionomer resin (a-1) and the nonionic resin (a-2) may be used in combination. When the ionomer resin (a-1) and the nonionic resin (a-2) are used in combination, the weight ratio [(a-1)/(a-2)] of the ionomer resin (a-1) with respect to the nonionic resin (a-2) is preferably equal to or greater than 1/99, more preferably equal to or greater than 5/95, and even more preferably equal to or greater than 10/90, and is preferably equal to or less than 90/10, more preferably equal to or less than 80/20, and even more preferably equal to or less than 70/30. When the weight ratio is in the above preferable range, the moldability of the golf ball improves, and particularly, a thin mid layer can be easily molded.

The following will describe the low melt viscosity ionomer resin (B).

The low melt viscosity ionomer resin (B) is one or two types selected from the group consisting of a neutralized product (b-1) and a neutralized product (b-2).

The neutralized product (b-1) is a compound obtained by neutralizing at least some of carboxyl groups in a binary copolymer formed with ethylene and an α,β-unsaturated carboxylic acid having 3 to 8 carbon atoms, with metal ions.

The neutralized product (b-2) is a compound obtained by neutralizing at least some of carboxyl groups in a ternary copolymer formed with ethylene, an α,β-unsaturated carboxylic acid having 3 to 8 carbon atoms, and an α,β-unsaturated carboxylic acid ester, with metal ions.

The low melt viscosity ionomer resin (B) may be a mixture of the neutralized product (b-1) and the neutralized product (b-2).

The melt viscosity (190° C.), measured with the Brookfield viscometer, of the low melt viscosity ionomer resin (B) is equal to or greater than 1 Pa·s and equal to or less than 10 Pa·s.

The same α,β-unsaturated carboxylic acid as the α,β-unsaturated carboxylic acid that can be included in the ionomer resin (a-1) can be used as the α,β-unsaturated carboxylic acid, having 3 to 8 carbon atoms, which can be included in the low melt viscosity ionomer resin (B). In other words, the same α,β-unsaturated carboxylic acid as the α,β-unsaturated carboxylic acid that can be included in the ionomer resin (a-1) can be used as the α,β-unsaturated carboxylic acid, having 3 to 8 carbon atoms, which can be included in the neutralized product (b-1) or the neutralized product (b-2).

The same α,β-unsaturated carboxylic acid ester as the α,β-unsaturated carboxylic acid ester that can be included in the ionomer resin (a-1) can be used as the α,β-unsaturated carboxylic acid ester of the neutralized product (b-2).

Examples of metal ions used for neutralizing the neutralized product (b-1) or the neutralized product (b-2) include monovalent alkali metal ions such as sodium, potassium, and lithium; bivalent metal ions such as magnesium, calcium, zinc, barium, and cadmium; trivalent metal ions such as aluminum; and other ions such as tin and zirconium. Among them, bivalent metal ions such as magnesium, calcium, zinc, barium, and cadmium are preferred.

The melt viscosity (190° C.), measured with the Brookfield viscometer, of the low melt viscosity ionomer resin (B) is equal to or greater than 1 Pa·s, preferably equal to or greater than 2 Pa·s, and more preferably equal to or greater than 3 Pa·s, and is equal to or less than 10 Pa·s, preferably equal to or less than 9 Pa·s, and more preferably equal to or less than 8 Pa·s. When the melt viscosity (190° C.) of the low melt viscosity ionomer resin (B) is equal to greater than 1 Pa·s, the compatibility between the low melt viscosity ionomer resin (B) and the high melt viscosity resin (A) is enhanced, and the durability of the golf ball improves. When the melt viscosity (190° C.) of the low melt viscosity ionomer resin (B) is equal to less than 10 Pa·s, the effect of improving the fluidity of the mid layer composition is great.

The melt flow rate (measurement temperature: 190° C., load: 2.16 kg) of the low melt viscosity ionomer resin (B) is preferably equal to or greater than 100 g/10 min, more preferably equal to or greater than 150 g/10 min, and even more preferably equal to or greater than 200 g/10 min, and is preferably equal to or less than 2000 g/10 min, more preferably equal to or less than 1900 g/10 min, and even more preferably equal to or less than 1800 g/10 min. When the melt flow rate of the low melt viscosity ionomer resin (B) is equal to or greater than 100 g/10 min, the effect of improving the fluidity of the mid layer composition is greater. When the melt flow rate of the low melt viscosity ionomer resin (B) is equal to or less than 2000 g/10 min, the compatibility between the low melt viscosity ionomer resin (B) and the high melt viscosity resin (A) component is enhanced, and the durability of the golf ball improves more.

A melt flow rate (MFR) is measured with a flow tester (SHIMADZU Flow Tester CFT-100C, manufactured by SHIMADZU CORPORATION) according to JIS K7210 under the conditions of: a measurement temperature of 190° C.; and a load of 2.16 kg.

The content of the α,β-unsaturated carboxylic acid component, having 3 to 8 carbon atoms, in the low melt viscosity ionomer resin (B) is preferably equal to or greater than 2% by weight and more preferably equal to or greater than 3% by weight, and is preferably equal to or less than 30% by weight and more preferably equal to or less than 20% by weight.

The degree of neutralization L1 of the carboxyl groups in the low melt viscosity ionomer resin (B) is preferably equal to or greater than 10 mol %, more preferably equal to or greater than 15 mol %, even more preferably equal to or greater than 20 mol %, and most preferably 100 mol %.

Where L2 (mole) denotes the number of moles of carboxyl group neutralized in the low melt viscosity ionomer resin (B) and T2 (mole) denotes the total number of moles of the carboxyl groups in the resin (B), the degree of neutralization L1 (mol %) can be calculated using the following formula.

$$L1=100*(L2/T2)$$

Specific examples of the low melt viscosity ionomer resin (B) include trade names "Aclyn 201 (Ca)", "Aclyn 246 (Mg)", and "Aclyn 295 (Zn)", available from Honeywell international Inc.

In the present invention, the ratio (weight ratio) A1/B1 of the high melt viscosity resin (A) with respect to the low melt viscosity ionomer resin (B) is considered. Preferably, in light of resilience performance, the ratio A1/B1 is preferably equal to or greater than 55/45, more preferably equal to or greater than 58/42, and even more preferably equal to or greater than 60/40. In light of fluidity of resin, the ratio A1/B1 is preferably equal to or less than 99/1, more preferably equal to or less than 90/10, and even more preferably equal to or less than 85/15. The ratio A1/B1 in this preferable range can contribute to reduction of the mid layer in thickness and the resilience performance and the durability of the mid layer.

The following will describe the metal ion source (C1).

The metal ion source (C1) is a basic metal compound that can neutralize non-neutralized carboxyl groups in the high melt viscosity resin (A) and the low melt viscosity ionomer resin (B). The metal ion source (C1) is not included in the resin component of the mid layer composition.

Examples of the metal ion source (C1) include metal hydroxides such as magnesium hydroxide, calcium hydroxide, sodium hydroxide, lithium hydroxide, potassium hydroxide, and copper hydroxide; metal oxides such as magnesium oxide calcium oxide, zinc oxide, and copper oxide; and metal carbonates such as magnesium carbonate, calcium carbonate, sodium carbonate, lithium carbonate, and potassium carbonate. One of these metal ion sources (C1) may be used solely, or two or more of these metal ion sources (C1) may be used in combination. Among them, as the metal ion source (C1), metal hydroxides are preferred, and magnesium hydroxide and calcium hydroxide are particularly suitable.

The amount of the metal ion source (C1) is equal to or greater than 0.1 part by weight, preferably equal to or greater than 0.2 part by weight, and more preferably equal to or greater than 0.3 part by weight, and is equal to or less than 10 parts by weight, preferably equal to or less than 9 parts by weight, and more preferably equal to or less than 8 parts by weight, per total 100 parts by weight of the high melt viscosity resin (A) and the low melt viscosity ionomer resin (B). When the amount of the metal ion source (C1) is in the above range, the resilience performance of the golf ball improves, and the moldability of the mid layer improves.

Preferably, the amount of the metal ion source (C1) is adjusted such that the degree of neutralization of all carboxyl groups included in the resin (A) and the resin (B) is equal to or greater than 50 mol %. More preferably, the amount of the metal ion source (C1) is adjusted such that the degree of neutralization of all the carboxyl groups included in the resin (A) and the resin (B) is equal to or greater than 75 mol %. Even more preferably, the amount of the metal ion source (C1) is adjusted such that the degree of neutralization of all the carboxyl groups included in the resin (A) and the resin (B) is equal to or greater than 80 mol %.

The resin component of the mid layer composition preferably includes only the high melt viscosity resin (A) and the low melt viscosity ionomer resin (B), but may include a thermoplastic resin and/or a thermosetting resin (hereinafter, referred to merely as resin (D)) in addition to the resin (A) and the resin (B) as long as it does not impair the effects of the present invention.

In this case, the amount of the resin (D) is preferably greater than 0 part by weight, more preferably equal to or greater than 1 part by weight, and even more preferably equal to or greater than 5 parts by weight, and is preferably equal to or less than 100 parts by weight, more preferably equal to or less than 70 parts by weight, and even more preferably equal to or less than 50 parts by weight, per total 100 parts by weight of the high melt viscosity resin (A) and the low melt viscosity ionomer resin (B). When the amount of the resin (D) is in the above range, desired properties, such as hardness and resilience characteristics, of the mid layer composition are likely to be obtained.

Examples of the resin (D) include thermoplastic resins including: thermoplastic polyamide elastomers available from Arkema Inc. as trade name "Pebax (e.g. "Pebax 2533")"; thermoplastic polyester elastomers available from Du Pont-Toray Co., Ltd. as trade name "Hytrel (e.g. "Hytrel 3548" and "Hytrel 4047")"; thermoplastic polystyrene elastomers available from Mitsubishi Chemical Corporation as trade name "Rabalon" or thermoplastic polyester elastomers available from Mitsubishi Chemical Corporation as trade name "Primalloy"; and a thermoplastic polyurethane elastomers available from BASF polyurethane elastomers Ltd as a trade name "Elastollan (e.g. "Elastollan ET880")". Other examples of the resin (D) include thermosetting resins including: resins obtained by crosslinking a rubber composition with sulfur, an organic peroxide, or the like; thermosetting polyurethane resins; epoxy resins; and phenolic resins. The resin (D) may be a mixture of a thermoplastic resin and a thermosetting resin.

A more preferable resin (D) is a thermoplastic resin. In light of resilience performance, the amount of the thermoplastic resin (D) is preferably equal to or greater than 1 part by weight, more preferably equal to or greater than 10 parts by weight, and more preferably equal to or greater than 20 parts by weight, per total 100 parts by weight of the high melt viscosity resin (A) and the low melt viscosity ionomer resin (B). In light of high fluidity, the amount of the thermoplastic resin (D) is preferably equal to or less than 95 parts by weight, more preferably equal to or less than 90 parts by weight, and more preferably equal to or less than 80 parts by weight, per total 100 parts by weight of the high melt viscosity resin (A) and the low melt viscosity ionomer resin (B).

Examples of the thermoplastic resin (D) include styrene elastomers, polyurethane elastomers, polyamide elastomers, and mixtures thereof. Specific examples of the thermoplastic resin (D) include thermoplastic polyamide elastomers available from Arkema Inc. as trade name "Pebax (e.g. "Pebax 2533")"; thermoplastic polyester elastomers available from Du Pont-Toray Co., Ltd. as trade name "Hytrel (e.g. "Hytrel 3548", "Hytrel 4047")"; thermoplastic polystyrene elastomers available from Mitsubishi Chemical Corporation as trade name "Rabalon" or thermoplastic polyester elastomers available from Mitsubishi Chemical Corporation as trade name "Primalloy"; and thermoplastic polyurethane elastomers available from BASF polyurethane elastomers Ltd as trade name "Elastollan (e.g. "Elastollan ET880")".

Examples of the above "Rabalon" include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", available from Mitsubishi Chemical Corporation.

Low-molecular materials such as aliphatic acids are not used for the mid layer 28. In the golf ball 22, deterioration of adhesion between the mid layer 28 and the adjacent layers, which is caused due to aliphatic acids and the like, does not occur.

From the standpoint that a thin mid layer 28 is easily formed due to high fluidity, the mid layer 28 has a melt flow rate of preferably 4 g/10 min or greater, more preferably 7 g/10 min or greater, and even more preferably 10 g/10 min or greater. The melt flow rate is preferably equal to or less than 40 g/10 min.

For measuring the melt flow rate (MFR) of the mid layer 28, the composition of the mid layer is used. The measurement is conducted using a flow tester (SHIMADZU Flow Tester CFT-100C, manufactured by SHIMADZU CORPORATION) according to JIS K7210 under the conditions of: a measurement temperature of 190° C.; and a load of 2.16 kg.

The reason why, in the present invention, the melt viscosity (190° C.) of the high melt viscosity resin (A) is regulated as a value measured with the flow tester and the melt viscosity (190° C.) of the low melt viscosity ionomer resin (B) is regulated as a value measured with the Brookfield viscometer, is that a measurement method suitable for measuring the range of the melt viscosity (190° C.) of each resin is used. These measurement methods are as described above, and specific examples of the measurement values of these resins are as described above.

In light of resilience performance, the mid layer 28 has a hardness Hm of preferably 35 or greater, more preferably 40 or greater, and particularly preferably 45 or greater. In light of feel at impact, the hardness Hm of the mid layer 28 is preferably equal to or less than 57, more preferably equal to or less than 55, and particularly preferably equal to or less than 52. The hardness Hm is measured according to the standards of "ASTM-D 2240-68" with a Shore D type spring hardness scale mounted to an automated rubber hardness measurement machine (trade name "P1", available from Kobunshi Keiki Co., Ltd.). For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the mid layer 28 is used for the measurement.

The mid layer 28 has a specific gravity G2 of preferably 1.10 or greater. Due to the mid layer 28, the weight distribution of the golf ball 22 can be biased such that the weight is greater on the outer side than on the inner side. Due to this bias, spin is suppressed. In these respects, the specific gravity G2 is more preferably equal to or greater than 1.15 and particularly preferably equal to or greater than 1.20. A great specific gravity G2 can be accomplished by including a filler with a high specific gravity. This filler decreases the resilience performance. In light of resilience performance, the specific gravity G2 is preferably equal to or less than 1.50, more preferably equal to or less than 1.45, and particularly preferably equal to or less than 1.40.

In order to accomplish the above preferable specific gravity G2, a filler with a high specific gravity may be included in the mid layer 28. A typical filler with a high specific gravity is powder of a metal with a high specific gravity. Typical metals with a high specific gravity are tungsten and molybdenum. In light of versatility, tungsten is preferred. The amount of powder of a metal with a high specific gravity is preferably adjusted such that the above preferable specific gravity G2 is accomplished.

When a filler with a high specific gravity is included, in light of suppression of spin, the amount of the filler with a high specific gravity is preferably equal to or greater than 20 parts by weight, more preferably equal to or greater than 25 parts by weight, and particularly preferably equal to or greater than 28 parts by weight, per 100 parts by weight of the base polymer of the mid layer 28. In light of ease of forming the mid layer 28, the amount of the filler is preferably equal to or less than 50 parts by weight and more preferably equal to or less than 40 parts by weight.

In light of durability of the golf ball 22, the mid layer 28 has a thickness of preferably 0.5 mm or greater, more preferably 0.6 mm or greater, and particularly preferably 0.7 mm or greater. From the standpoint that the core 24 with a sufficient diameter can be formed, the thickness of the mid layer 28 is preferably equal to or less than 1.6 mm, more preferably equal to or less than 1.2 mm, and particularly preferably equal to or less than 1.0 mm.

From the standpoint that the core 24 with a sufficient diameter can be formed, the mid layer 28 has an outer diameter of preferably 40.7 mm or greater, more preferably 40.9 mm or greater, and particularly preferably 41.2 mm or greater. The outer diameter of the mid layer 28 is preferably equal to or less than 42.2 mm.

A resin composition is suitably used for the cover 30. Examples of the base polymer of this resin composition include ionomer resins, styrene block-containing thermoplastic elastomers, thermoplastic polyester elastomers, thermoplastic polyamide elastomers, and thermoplastic polyolefin elastomers. Particularly, ionomer resins are preferred. Ionomer resins are highly elastic. The golf ball 22 with the cover 30 including an ionomer resin has excellent resilience performance. The ionomer resins described above for the mid layer 28 can be used for the cover 30.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. This binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. This ternary copolymer has excellent resilience performance. For the binary copolymer and ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball are sodium ion, zinc ion, lithium ion, and magnesium ion.

Specific examples of the ionomer resin that can be used for the cover are as described above.

Two or more types of ionomer resins may be used in combination for the cover 30. An ionomer resin neutralized with a monovalent metal ion, and an ionomer resin neutralized with a bivalent metal ion may be used in combination.

An example of a resin that can be used in combination with an ionomer resin is a styrene block-containing thermoplastic elastomer. This elastomer can contribute to the feel at impact of the golf ball 22. This elastomer does not impair the resilience performance of the golf ball 22. This elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 22, the content of the styrene component in the thermoplastic elastomer is preferably equal to or greater than 10% by weight, more preferably equal to or greater than 12% by weight, and particularly preferably equal to or greater than 15% by weight. In light of feel at impact of the golf ball 22, the content is preferably equal to or less than 50% by weight, more preferably equal to or less than 47% by weight, and particularly preferably equal to or less than 45% by weight.

In the present specification, styrene block-containing thermoplastic elastomers include alloys of olefin and one or more types selected from the group consisting of SBS, SIS, SIBS, SEBS, SEPS, SEEPS, and hydrogenated products thereof. An olefin component in the alloy is presumed to contribute to improvement of compatibility with ionomer resins. Use of this alloy improves the resilience performance of the golf ball 22. An olefin having 2 to 10 carbon atoms is preferably used. Examples of suitable olefins include ethylene, propylene, butene, and pentene. Ethylene and propylene are particularly preferred.

Specific examples of polymer alloys are as described above.

When an ionomer resin and a styrene block-containing thermoplastic elastomer are used in combination for the cover 30, the weight ratio of them is preferably equal to or greater than 60/40. The cover 30 with a weight ratio of 60/40 or greater contributes to the resilience performance of the golf ball 22. In this respect, the ratio is more preferably equal to or greater than 75/25 and particularly preferably equal to or greater than 85/15. In light of feel at impact, the ratio is preferably equal to or less than 98/2. This weight ratio is the ratio of the weight of the ionomer resin with respect to the weight of the styrene block-containing thermoplastic elastomer.

An ionomer resin and the high melt viscosity nonionic resin (a-2) may be used in combination for the cover 30. Use of the nonionic resin (a-2) can contribute to improvement of the moldability and the durability. In light of moldability, the weight ratio of the nonionic resin (a-2) with respect to the ionomer resin is preferably equal to or greater than 10/90 and more preferably equal to or greater than 20/80. In light of resilience performance, the weight ratio is preferably equal to or less than 40/60.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 30 in an adequate amount. For forming the cover 30, known methods such as injection molding, compression molding, and the like can be used. When forming the cover 30, the dimples 32 are formed by pimples formed on the cavity face of a mold.

In light of suppression of spin, the cover 30 has a hardness Hc of preferably 56 or greater, more preferably 58 or greater, and particularly preferably 59 or greater. In light of feel at impact, the hardness Hc is preferably equal to or less than 65, more preferably equal to or less than 64, and particularly preferably equal to or less than 63. The hardness Hc is measured according to the standards of "ASTM-D 2240-68" with a Shore D type spring hardness scale mounted to an automated rubber hardness measurement machine (trade name "P1", available from Kobunshi Keiki Co., Ltd.). For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the cover 30 is used for the measurement.

In light of suppression of spin, the cover 30 has a specific gravity G3 of preferably 0.97 or greater and more preferably 1.00 or greater. In light of moldability of the cover 30, the specific gravity G3 is preferably equal to or less than 1.20 and more preferably equal to or less than 1.15.

In light of ease of forming the cover 30, the cover 30 has a thickness of preferably 0.3 mm or greater, more preferably 0.5 mm or greater, and particularly preferably 0.7 mm or greater. The core 24 with a large outer diameter contributes to resilience performance. In light of outer diameter of the core 24, the thickness of the cover 30 is preferably equal to or less than 1.6 mm, more preferably equal to or less than 1.2 mm, and particularly preferably equal to or less than 1.0 mm.

In light of feel at impact, the golf ball 22 has the amount of compressive deformation of preferably 2.5 mm or greater, more preferably 2.7 mm or greater, and particularly preferably 2.9 mm or greater. In light of resilience performance, the amount of compressive deformation is preferably equal to or less than 4.0 mm, more preferably equal to or less than 3.8 mm, and particularly preferably equal to or less than 3.5 mm.

EXAMPLES

The following will show the effects of the present invention by means of Examples, but the present invention should not be construed in a limited manner based on the description of these Examples.

The following test 1 relates to the first aspect of the present invention. The following test 2 relates to the second aspect of the present invention.

[Test 1]

[Sample 1a]

A rubber composition (i) was obtained by kneading 100 parts by weight of a high-cis polybutadiene (trade name "BR-730", available from JSR Corporation), 7 parts by weight of zinc diacrylate, 5 parts by weight of zinc oxide, 2.6 parts by weight of barium sulfate, 0.5 part by weight of diphenyl disulfide (available from Sumitomo Seika Chemicals Co., Ltd.), and 0.6 part by weight of dicumyl peroxide (available from NOF Corporation). This rubber composition (i) was placed into a mold including upper and lower mold halves each having a hemispherical cavity, and compressed and heated to obtain a center with a diameter of 15.0 mm.

A rubber composition (c) was obtained by kneading 100 parts by weight of a high-cis polybutadiene (the aforementioned "BR-730"), 31 parts by weight of zinc diacrylate, 5 parts by weight of zinc oxide, 12.3 parts by weight of barium sulfate, 0.5 part by weight of diphenyl disulfide (available from Sumitomo Seika Chemicals Co., Ltd.), and 0.6 part by weight of dicumyl peroxide (available from NOF Corporation). Two half shells were molded from this rubber composition (c). The center was covered with the two half shells. The center and the half shells were placed into a mold including upper and lower mold halves each having a hemispherical cavity, and heated at 170° C. for 20 minutes to obtain a core with a diameter of 39.4 mm.

A resin composition (b) was obtained by kneading 15 parts by weight of an ionomer resin (a-1) (the aforementioned "Himilan 1555"), 40 parts by weight of another ionomer resin (a-1) (the aforementioned "Himilan AM7329"), 20 parts by weight of a nonionic resin (a-2) (the aforementioned "NUCREL N1050H"), 25 parts by weight of a low melt viscosity ionomer resin (B) (the aforementioned "Aclyn 295"), and 1.7 parts by weight of $Mg(OH)_2$ (available from YONEYAMA YAKUHIN KOGYO CO., LTD.) with a twin-screw kneading extruder. The core was placed into a mold including upper and lower mold halves each having a hemispherical cavity. The core was covered with the resin composition (b) by injection molding to form a mid layer with a thickness of 0.9 mm, resulting in a sphere (k) with a diameter of 41.2 mm.

A resin composition (h) was obtained by kneading 33 parts by weight of an ionomer resin (the aforementioned "Surlyn 8945"), 50 parts by weight of another ionomer resin (the aforementioned "Himilan AM7329"), 17 parts by weight of an ethylene-methacrylic acid copolymer resin (the aforementioned "NUCREL N1050H"), 3 parts by weight of titanium dioxide, and 0.04 part by weight of ultramarine blue with a twin-screw kneading extruder. The sphere (k) was placed into a final mold that includes upper and lower mold halves each having a hemispherical cavity and that has a large number of pimples on its cavity face. The sphere (k) was covered with the resin composition (h) by injection molding to form a cover with a thickness of 0.8 mm. A large number of dimples having a shape that is the inverted shape of the pimples were formed on the cover. A clear paint including a two-component curing type polyurethane as a base material was applied to this cover to obtain a golf ball of Sample 1a with a diameter of 42.8 mm and a weight of about 45.4 g.

[Samples 2a to 13a and Samples 1b to 9b]

Golf balls of Samples 2a to 13a and Samples 1b to 9b were obtained in a similar manner as Sample 1a, except the specifications of the core, the mid layer, and the cover were as shown in the following Tables 5 to 7. The rubber composition of the center is shown in detail in the following Table 1. The resin composition of the envelope layer is shown in detail in the following Table 2. The resin composition of the mid layer is shown in detail in the following Table 3. The resin composition of the cover is shown in detail in the following Table 4.

It is noted that the golf balls of Samples 6b and 7b with the specifications shown in Table 7 were attempted to be manufactured, but the fluidity of the mid layer composition was poor and hence the mid layer could not be molded.

[Evaluation of Flight Distance]

A driver with a titanium head (trade name "XXIO", available from SRI Sports Limited, shaft hardness: R, loft angle: 11.0° was attached to a swing machine available from True Temper Co. A golf ball was hit under the condition of a head speed of 45 m/sec, and the distance from the launch point to the stop point was measured. The average value of data obtained by 10 measurements is shown in the following Tables 5 to 7.

[Evaluation of Durability]

A golf ball maintained at 23° C. for 1 month after finished was evaluated. A driver with a titanium head (trade name "XXIO", available from SRI Sports Limited, shaft hardness: R, loft angle: 11.0° was attached to a swing machine available from True Temper Co. The golf ball was hit with the swing machine under the condition of a head speed of 45 m/sec. This hitting was repeated, and the number of hits required to break the golf ball was counted. The average value of data obtained by 5 measurements is shown as an index in the following Tables 5 to 7. The average value for Sample 5a is defined as an index of 100.

[Evaluation of Feel at Impact]

Golf players hit golf balls with drivers. Feel at impact was categorized based on the following criteria.

A: Soft
B: Slightly soft
C: Slightly hard
D: Hard

TABLE 1

Composition (parts by weight), Specific Gravity, and Rubber Percentage of Center

| | 1 | 2 | 3 | 4 | 5 |
|---|---|---|---|---|---|
| BR-730 | 100 | 100 | 100 | 100 | 100 |
| Zinc diacrylate | 7 | 7 | 7 | 14 | 12 |
| Zinc oxide | 5 | 5 | 5 | 5 | 5 |
| Barium sulfate | 2.6 | 22 | 28 | | 1 |
| Diphenyl disulfide | 0.5 | 0.5 | 0.5 | 0.5 | 0.5 |
| Dicumyl peroxide | 0.6 | 0.6 | 0.6 | 0.6 | 0.6 |
| Specific gravity | 1.00 | 1.13 | 1.16 | 1.00 | 1.00 |
| Rubber percentage R1 | 86.4 | 74.0 | 70.9 | 83.3 | 84.0 |

TABLE 2

| Composition (parts by weight) and Specific Gravity of Envelope Layer | | | | | | | | | |
|---|---|---|---|---|---|---|---|---|---|
| | 1 | 2 | 3 | 4 | 5 | 6 | 7 | 8 | 9 |
| BR-730 | 100 | 100 | 100 | 100 | 100 | 100 | 100 | 100 | 100 |
| Zinc diacrylate | 31 | 31 | 31 | 33 | 30 | 30.5 | 29 | 30 | 31 |
| Zinc oxide | 5 | 5 | 5 | 5 | 10 | 10 | 10 | 10 | 5 |
| Barium sulfate | 12.3 | 10.4 | 10 | 12.8 | 12.6 | 12.4 | 12.1 | 12.1 | 18.5 |
| Diphenyl disulfide | 0.5 | 0.5 | 0.5 | 0.5 | 0.5 | 0.5 | 0.5 | 0.5 | 0.5 |
| Dicumyl peroxide | 0.6 | 0.6 | 0.6 | 0.6 | 0.6 | 0.6 | 0.6 | 0.6 | 0.6 |
| Specific gravity | 1.125 | 1.115 | 1.113 | 1.133 | 1.125 | 1.125 | 1.121 | 1.122 | 1.160 |

TABLE 3

| Composition and Specifications of Mid Layer | | | | | | | | | | | | | |
|---|---|---|---|---|---|---|---|---|---|---|---|---|---|
| | A | B | C | D | E | F | G | H | I | J | K | L | M |
| Himilan 1555 | 15 | 15 | 35 | 7 | 40 | 10 | | 35 | 15 | 15 | 15 | 15 | 15 |
| Himilan AM7329 | 40 | 40 | 40 | 30 | 40 | 20 | 29 | 40 | 40 | 40 | 30 | 40 | 40 |
| NUCREL N1050H | 20 | 20 | 20 | 20 | 20 | 20 | 20 | 15 | 20 | 20 | 15 | 20 | 20 |
| Aclyn 295 | 25 | 25 | 5 | 43 | | 50 | 15 | 10 | 25 | 25 | 20 | 25 | 25 |
| $Mg(OH)_2$ | 1.7 | 1.7 | 1.7 | 1.7 | 1.7 | 1.7 | 1.7 | 1.7 | 0.05 | 11 | 1.7 | 1.7 | 8 |
| Rabalon T3221C | | | | | | | 36 | | | | 20 | | |
| Behenic acid *1 | | | | | | | | | | | | 10 | |
| Tungsten *2 | | 28 | 28 | 28 | 28 | 28 | 28 | 28 | 28 | 28 | 28 | 28 | 28 |
| Hardness H2 (JIS-C) | 80 | 80 | 85 | 78 | 87 | 77 | 58 | 87 | 79 | 83 | 76 | 79 | 82 |
| Specific gravity G2 | 0.97 | 1.23 | 1.23 | 1.23 | 1.22 | 1.24 | 1.22 | 1.23 | 1.23 | 1.23 | 1.22 | 1.23 | 1.23 |
| Melt flow rate (190° C., 2.16 kg) | 15 | 15 | 5 | 30 | 3 | 40 | 11 | 7 | 33 | 1 | 8 | 30 | 5 |

*1 Trade name "NAA-222S powder" (available from NOF Corporation)
*2 Tungsten powder of trade name "C50G" (available from A.L.M.T. Corp.)

TABLE 4

| Composition and Hardness of Cover | | |
|---|---|---|
| | A | B |
| Surlyn 8945 | 33 | 22 |
| Himilan AM7329 | 50 | 50 |
| NUCREL N1050H | 17 | 18 |
| Rabalon T3221C | | 10 |

TABLE 4-continued

| Composition and Hardness of Cover | | |
|---|---|---|
| | A | B |
| Titanium dioxide | 3 | 3 |
| Ultramarine blue | 0.04 | 0.04 |
| Hardness H3 (JIS-C) | 90 | 84 |

TABLE 5

| Specifications and Evaluation Results of Samples | | | | | | |
|---|---|---|---|---|---|---|
| | | Sample 1a | Sample 2a | Sample 3a | Sample 4a | Sample 5a |
| Center | Composition | 1 | 2 | 1 | 1 | 1 |
| | Outer diameter (mm) | 15 | 15 | 15 | 15 | 15 |
| | Central hardness H1 (JIS-C) | 30 | 30 | 30 | 30 | 30 |
| | Surface hardness H5 (JIS-C) | 40 | 40 | 40 | 40 | 40 |
| Envelope layer | Composition | 1 | 2 | 8 | 9 | 1 |
| | Outer diameter (mm) | 39.4 | 39.4 | 38.4 | 39.4 | 39.4 |
| | Surface hardness H4 (JIS-C) | 83 | 83 | 83 | 83 | 83 |
| Mid layer | Composition | B | B | B | A | L |
| | Hardness H2 (JIS-C) | 80 | 80 | 80 | 80 | 79 |
| | Outer diameter (mm) | 41.2 | 41.2 | 41.2 | 41.2 | 41.2 |
| | Thickness (mm) | 0.9 | 0.9 | 1.4 | 0.9 | 0.9 |
| Cover | Composition | A | A | A | A | A |
| | Hardness H3 (JIS-C) | 90 | 90 | 90 | 90 | 90 |
| | Thickness (mm) | 0.8 | 0.8 | 0.8 | 0.8 | 0.8 |
| | Hardness difference (H3-H1) | 60 | 60 | 60 | 60 | 60 |
| Ball characteristics | Amount of compressive deformation (mm) | 3.3 | 3.3 | 3.3 | 3.3 | 3.3 |
| | Flight distance (m) | 236 | 233 | 232 | 233 | 232 |
| | Durability | 165 | 165 | 170 | 165 | 100 |
| | Feel at impact | A | A | A | A | A |

TABLE 6

Specifications and Evaluation Results of Samples

| | | Sample 6a | Sample 7a | Sample 8a | Sample 9a | Sample 10a | Sample 11a | Sample 12a | Sample 13a |
|---|---|---|---|---|---|---|---|---|---|
| Center | Composition | 1 | 1 | 1 | 1 | 1 | 1 | 1 | 1 |
| | Outer diameter (mm) | 15 | 15 | 15 | 15 | 15 | 15 | 15 | 15 |
| | Central hardness H1 (JIS-C) | 30 | 30 | 30 | 30 | 30 | 30 | 30 | 30 |
| | Surface hardness H5 (JIS-C) | 40 | 40 | 40 | 40 | 40 | 40 | 40 | 40 |
| Envelope layer | Composition | 1 | 1 | 1 | 1 | 1 | 1 | 1 | 1 |
| | Outer diameter (mm) | 39.4 | 39.4 | 39.4 | 39.4 | 39.4 | 39.4 | 39.4 | 39.4 |
| | Surface hardness H4 (JIS-C) | 83 | 83 | 83 | 83 | 83 | 83 | 83 | 83 |
| Mid layer | Composition | C | D | F | I | K | B | M | H |
| | Hardness H2 (JIS-C) | 85 | 78 | 77 | 79 | 76 | 80 | 82 | 87 |
| | Outer diameter (mm) | 41.2 | 41.2 | 41.2 | 41.2 | 41.2 | 41.2 | 41.2 | 41.2 |
| | Thickness (mm) | 0.9 | 0.9 | 0.9 | 0.9 | 0.9 | 0.9 | 0.9 | 0.9 |
| Cover | Composition | A | A | A | A | A | B | A | A |
| | Hardness H3 (JIS-C) | 90 | 90 | 90 | 90 | 90 | 84 | 90 | 90 |
| | Thickness (mm) | 0.8 | 0.8 | 0.8 | 0.8 | 0.8 | 0.8 | 0.8 | 0.8 |
| | Hardness difference (H3-H1) | 60 | 60 | 60 | 60 | 60 | 54 | 60 | 60 |
| Ball characteristics | Amount of compressive deformation (mm) | 3.2 | 3.3 | 3.3 | 3.3 | 3.3 | 3.4 | 3.3 | 3.2 |
| | Flight distance (m) | 235 | 232 | 228 | 229 | 237 | 230 | 237 | 237 |
| | Durability | 142 | 174 | 174 | 156 | 162 | 177 | 160 | 150 |
| | Feel at impact | A | A | A | A | A | A | A | B |

TABLE 7

Specifications and Evaluation Results of Samples

| | | Sample 1b | Sample 2b | Sample 3b | Sample 4b | Sample 5b | Sample 6b | Sample 7b | Sample 8b | Sample 9b |
|---|---|---|---|---|---|---|---|---|---|---|
| Center | Composition | 3 | 1 | 4 | 5 | 1 | 1 | 1 | 1 | 1 |
| | Outer diameter (mm) | 15 | 20 | 15 | 15 | 15 | 15 | 15 | 15 | 15 |
| | Central hardness H1 (JIS-C) | 30 | 30 | 53 | 46 | 30 | 30 | 30 | 30 | 30 |
| | Surface hardness H5 (JIS-C) | 40 | 40 | 58 | 53 | 40 | 40 | 40 | 40 | 40 |
| Envelope layer | Composition | 3 | 4 | 5 | 6 | 7 | 1 | 1 | 1 | 1 |
| | Outer diameter (mm) | 39.4 | 39.4 | 39.4 | 39.4 | 36.8 | 39.4 | 39.4 | 39.4 | 39.4 |
| | Surface hardness H4 (JIS-C) | 83 | 85 | 82 | 82 | 82 | 83 | 83 | 83 | 83 |
| Mid layer | Composition | B | B | B | B | B | E | J | G | C |
| | Hardness H2 (JIS-C) | 80 | 80 | 80 | 80 | 80 | 87 | 83 | 58 | 85 |
| | Outer diameter (mm) | 41.2 | 41.2 | 41.2 | 41.2 | 39.6 | 41.2 | 41.2 | 41.2 | 41.2 |
| | Thickness (mm) | 0.9 | 0.9 | 0.9 | 0.9 | 1.4 | 0.9 | 0.9 | 0.9 | 0.9 |
| Cover | Composition | A | A | A | A | A | A | A | A | B |
| | Hardness H3 (JIS-C) | 90 | 90 | 90 | 90 | 90 | 90 | 90 | 90 | 84 |
| | Thickness (mm) | 0.8 | 0.8 | 0.8 | 0.8 | 1.6 | 0.8 | 0.8 | 0.8 | 0.8 |
| | Hardness difference (H3-H1) | 60 | 60 | 37 | 44 | 60 | 60 | 60 | 60 | 54 |
| Ball characteristics | Amount of compressive deformation (mm) | 3.3 | 3.3 | 3.3 | 3.3 | 3.3 | Molding was impossible | Molding was impossible | 3.4 | 3.2 |
| | Flight distance (m) | 230 | 228 | 227 | 228 | 228 | | | 227 | 226 |
| | Durability | 164 | 144 | 170 | 168 | 171 | | | 178 | 164 |
| | Feel at impact | A | A | B | B | C | | | A | B |

"Himilan 1555" is a sodium ion neutralized ethylene-methacrylic acid copolymer ionomer resin, and corresponds to the above ionomer resin (a-1). "Himilan AM7329" is a zinc ion neutralized ethylene-methacrylic acid copolymer ionomer resin, and corresponds to the above ionomer resin (a-1). "NUCREL N1050H" is an ethylene-methacrylic acid copolymer resin, and corresponds to the above nonionic resin (a-2). "Aclyn 295" is a zinc neutralized product of a binary copolymer formed with ethylene and an α,β-unsaturated carboxylic acid having 3 to 8 carbon atoms, and corresponds to the above low melt viscosity ionomer resin (B). $Mg(OH)_2$ corresponds to the above metal ion source (C1). "Rabalon T3221C" is a styrene elastomer, and corresponds to the above thermoplastic resin (D).

As shown in Tables 5 to 7, the golf balls of Samples 1a to 13a are excellent in various performance characteristics, in comparison with the golf balls of Samples 1b to 9b. From the results of evaluation of Test 1, advantages of the present invention according to the first aspect are clear.

[Test 2]

[Sample 1c]

A rubber composition (i) was obtained by kneading 100 parts by weight of a high-cis polybutadiene (trade name "BR-730", available from JSR Corporation), 28.5 parts by weight of zinc diacrylate, 10 parts by weight of zinc oxide, 19 parts by weight of barium sulfate, 0.5 part by weight of diphenyl disulfide (available from Sumitomo Seika Chemicals Co., Ltd.), and 0.6 part by weight of dicumyl peroxide (available from NOF Corporation). This rubber composition (i) was placed into a mold including upper and lower mold halves each having a hemispherical cavity, and compressed and heated to obtain a core with a diameter of 39.4 mm.

A resin composition (b) was obtained by kneading 15 parts by weight of an ionomer resin (a-1) (the aforementioned "Himilan 1555"), 40 parts by weight of another ionomer resin (a-1) (the aforementioned "Himilan AM7329"), and 20 parts by weight of a nonionic resin (a-2) (the aforementioned "NUCREL N1050H"), 25 parts by weight of a low melt viscosity ionomer resin (B) (the aforementioned "Aclyn 295"), and 1.7 parts by weight of $Mg(OH)_2$ (available from YONEYAMA YAKUHIN KOGYO CO., LTD.) with a twin-screw kneading extruder. The core was placed into a mold including upper and lower mold halves each having a hemispherical cavity. The core was covered with the resin composition (b) by injection molding to form a mid layer with a thickness of 0.9 mm, resulting in a sphere (k).

A resin composition (h) was obtained by kneading 32 parts by weight of an ionomer resin (the aforementioned "Surlyn 8945"), 50 parts by weight of another ionomer resin (the aforementioned "Himilan AM7329"), 18 parts by weight of an ethylene-methacrylic acid copolymer resin (the aforementioned "NUCREL N1050H"), 3 parts by weight of titanium dioxide, and 0.04 part by weight of ultramarine blue with a twin-screw kneading extruder. The sphere (k) was placed into a final mold that includes upper and lower mold halves each having a hemispherical cavity and that has a large number of pimples on its cavity face. The sphere (k) was covered with the resin composition (h) by injection molding to form a cover with a thickness of 0.8 mm. A large number of dimples having a shape that is the inverted shape of the pimples were formed on the cover. A clear paint including a two-component curing type polyurethane as a base material was applied to this cover to obtain a golf ball of Sample 1c with a diameter of 42.8 mm and a weight of about 45.4 g.

[Samples 2c to 9c and Samples 1d to 7d]

Golf balls of Samples 2c to 9c and Samples 1d to 7d were obtained in a similar manner as Sample 1c, except the specifications of the core, the mid layer, and the cover were as shown in the following Tables 11 and 12. The rubber composition of the core is shown in detail in the following Table 8. The resin composition of the mid layer is shown in detail in the following Table 9. The resin composition of the cover is shown in detail in the following Table 10.

It is noted that the golf balls of Samples 1d and 4d with the specifications shown in Table 12 were attempted to be manufactured, but the fluidity of the mid layer composition was poor and hence the mid layer could not be molded.

[Evaluation of Flight Distance]

The measurement was conducted by the same method as the above Test 1. The average value of data obtained by 10 measurements is shown in the following Tables 11 and 12.

[Evaluation of Durability]

The measurement was conducted by the same method as the above Test 1. The average value of data obtained by 5 measurements is shown as an index in the following Tables 11 and 12. The average value for Sample 3c is defined as an index of 100.

[Evaluation of Feel at Impact]

Golf players hit golf balls with drivers. Feel at impact was categorized based on the following criteria.

A: Soft

B: Slightly soft

C: Slightly hard

D: Hard

TABLE 8

Composition (parts by weight) of Core

| | 1 | 2 | 3 | 4 | 5 |
|---|---|---|---|---|---|
| BR-730 | 100 | 100 | 100 | 100 | 100 |
| Zinc diacrylate | 28.5 | 28.5 | 27.5 | 27.0 | 29.0 |
| Zinc oxide | 10 | 10 | 10 | 10 | 10 |
| Barium sulfate | 19 | 12 | 12.4 | 12.6 | 11.8 |
| Diphenyl disulfide | 0.5 | 0.5 | 0.5 | 0.5 | 0.5 |
| Dicumyl peroxide | 0.6 | 0.6 | 0.6 | 0.6 | 0.6 |

TABLE 9

Composition and Specifications of Mid Layer

| | A | B | C | D | E | F | G | H | I | J | K | L | M |
|---|---|---|---|---|---|---|---|---|---|---|---|---|---|
| Himilan 1555 | 15 | 15 | 35 | 7 | 40 | 10 | | 35 | 15 | 15 | 15 | 15 | 15 |
| Himilan AM7329 | 40 | 40 | 40 | 30 | 40 | 20 | 30 | 40 | 40 | 40 | 30 | 40 | 40 |
| NUCREL N1050H | 20 | 20 | 20 | 20 | 20 | 20 | 20 | 15 | 20 | 20 | 15 | 20 | 20 |
| Aclyn 295 | 25 | 25 | 5 | 43 | | 50 | 15 | 10 | 25 | 25 | 20 | 25 | 25 |
| $Mg(OH)_2$ | 1.7 | 1.7 | 1.7 | 1.7 | 1.7 | 1.7 | 1.7 | 1.7 | 0.05 | 11 | 1.7 | 1.7 | 8 |
| Rabalon T3221C | | | | | | | 35 | | | | 20 | | |
| Behenic acid *1 | | | | | | | | | | | | 10 | |
| Tungsten *2 | | 28 | 28 | 28 | 28 | 28 | 28 | 28 | 28 | 28 | 28 | 28 | 28 |
| Hardness Hm (Shore D) | 51 | 51 | 56 | 49 | 58 | 48 | 33 | 58 | 50 | 53 | 47 | 50 | 52 |
| Specific gravity G2 | 0.97 | 1.23 | 1.23 | 1.23 | 1.22 | 1.24 | 1.22 | 1.23 | 1.23 | 1.23 | 1.22 | 1.23 | 1.23 |
| Melt flow rate (190° C., 2.16 kg) | 15 | 15 | 5 | 30 | 3 | 40 | 11 | 7 | 33 | 1 | 8 | 30 | 5 |

*1 Trade name "NAA-222S powder" (available from NOF Corporation)

*2 Tungsten powder of trade name "C50G" (available from A.L.M.T. Corp.)

TABLE 10

Composition and Hardness of Cover

| | A | B |
|---|---|---|
| Surlyn 8945 | 32 | 22 |
| Himilan AM7329 | 50 | 50 |
| NUCREL N1050H | 18 | 18 |
| Rabalon T3221C | | 10 |
| Titanium dioxide | 3 | 3 |
| Ultramarine blue | 0.04 | 0.04 |
| Hardness Hc (Shore D) | 60 | 55 |

TABLE 11

Specifications and Evaluation Results of Samples

| | | Sample 1c | Sample 2c | Sample 3c | Sample 4c | Sample 5c | Sample 6c | Sample 7c | Sample 8c | Sample 9c |
|---|---|---|---|---|---|---|---|---|---|---|
| Core | Composition | 1 | 2 | 2 | 2 | 2 | 2 | 2 | 2 | 2 |
| | Outer diameter (mm) | 39.4 | 39.4 | 39.4 | 39.4 | 39.4 | 39.4 | 39.4 | 39.4 | 39.4 |
| | Central hardness H1c (Shore D) | 40 | 40 | 40 | 40 | 40 | 40 | 40 | 40 | 40 |
| | Surface hardness H1s (Shore D) | 53 | 53 | 53 | 53 | 53 | 53 | 53 | 53 | 53 |
| Mid layer | Composition | A | B | L | C | D | K | M | F | I |
| | Hardness Hm (Shore D) | 51 | 51 | 50 | 56 | 49 | 47 | 52 | 48 | 50 |
| | Outer diameter (mm) | 41.2 | 41.2 | 41.2 | 41.2 | 41.2 | 41.2 | 41.2 | 41.2 | 41.2 |
| | Thickness (mm) | 0.9 | 0.9 | 0.9 | 0.9 | 0.9 | 0.9 | 0.9 | 0.9 | 0.9 |
| Cover | Composition | A | A | A | A | A | A | A | A | A |
| | Hardness Hc (Shore D) | 60 | 60 | 60 | 60 | 60 | 60 | 60 | 60 | 60 |
| | Thickness (mm) | 0.8 | 0.8 | 0.8 | 0.8 | 0.8 | 0.8 | 0.8 | 0.8 | 0.8 |
| Ball characteristics | Amount of compressive deformation (mm) | 3.2 | 3.2 | 3.2 | 3.1 | 3.2 | 3.2 | 3.2 | 3.2 | 3.2 |
| | Flight distance (m) | 232 | 235 | 232 | 234 | 231 | 236 | 236 | 229 | 230 |
| | Durability | 150 | 155 | 100 | 133 | 168 | 154 | 150 | 170 | 150 |
| | Feel at impact | A | A | A | A | A | A | A | A | A |

TABLE 12

Specifications and Evaluation Results of Samples

| | | Sample 1d | Sample 2d | Sample 3d | Sample 4d | Sample 5d | Sample 6d | Sample 7d |
|---|---|---|---|---|---|---|---|---|
| Core | Composition | 2 | 5 | 3 | 2 | 2 | 4 | 4 |
| | Outer diameter (mm) | 39.4 | 39.4 | 39.4 | 39.4 | 39.4 | 37.8 | 37.6 |
| | Central hardness H1c (Shore D) | 40 | 41 | 39 | 40 | 40 | 38 | 38 |
| | Surface hardness H1s (Shore D) | 53 | 54 | 52 | 53 | 53 | 51 | 51 |
| Mid layer | Composition | E | G | H | J | B | B | B |
| | Hardness Hm (Shore D) | 58 | 33 | 58 | 53 | 51 | 51 | 51 |
| | Outer diameter (mm) | 41.2 | 41.2 | 41.2 | 41.2 | 41.2 | 41.2 | 39.4 |
| | Thickness (mm) | 0.9 | 0.9 | 0.9 | 0.9 | 0.9 | 1.7 | 0.9 |
| Cover | Composition | A | A | A | A | B | A | A |
| | Hardness Hc (Shore D) | 60 | 60 | 60 | 60 | 55 | 60 | 60 |
| | Thickness (mm) | 0.8 | 0.8 | 0.8 | 0.8 | 0.8 | 0.8 | 1.7 |
| Ball characteristics | Amount of compressive deformation (mm) | Molding was impossible | 3.2 | 3.2 | Molding was impossible | 3.3 | 3.2 | 3.2 |
| | Flight distance (m) | | 227 | 236 | | 227 | 228 | 229 |
| | Durability | | 155 | 148 | | 168 | 148 | 144 |
| | Feel at impact | | A | D | | A | C | C |

"Himilan 1555" is a sodium ion neutralized ethylene-methacrylic acid copolymer ionomer resin, and corresponds to the above ionomer resin (a-1). "Himilan AM7329" is a zinc ion neutralized ethylene-methacrylic acid copolymer ionomer resin, and corresponds to the above ionomer resin (a-1). "NUCREL N1050H" is an ethylene-methacrylic acid copolymer resin, and corresponds to the above nonionic resin (a-2). "Aclyn 295" is a zinc neutralized product of a binary copolymer formed with ethylene and an α,β-unsaturated carboxylic acid having 3 to 8 carbon atoms, and corresponds to the above low melt viscosity ionomer resin (B). $Mg(OH)_2$ corresponds to the above metal ion source (C1). "Rabalon T3221C" is a styrene elastomer, and corresponds to the above thermoplastic resin (D).

As shown in Tables 11 and 12, the golf balls of Samples 1c to 9c are excellent in various performance characteristics, in comparison with the golf balls of Samples 1d to 7d. From the results of evaluation of Test 2, advantages of the present invention according to the second aspect are clear.

The golf ball according to the present invention can be used for playing golf on a golf course and practicing at a driving range.

The above description is merely for illustrative examples, and various modifications can be made without departing from the principles of the present invention.

What is claimed is:

1. A golf ball comprising a center having a diameter of 5 mm or greater and 19 mm or less and a rubber percentage of 73% by weight or greater, wherein the center has a JIS-C central hardness H1 of 20 or greater and 50 or less, an envelope layer having an outer diameter of 37.0 mm or greater positioned outside the center, a mid layer positioned outside the envelope layer, the principal component of the mid layer being an ionomer resin, and a cover positioned outside the mid layer, wherein the center has a diameter of 5 mm or greater and 19 mm or less, the center has a rubber percentage of 73% by weight or greater, the center has a JIS-C central hardness H1 of 20 or greater and 50 or less, the envelope layer has an outer diameter of 37.0 mm or greater, the mid layer has a JIS-C hardness H2 less than the JIS-C hardness H3 of the cover, the principal component of the mid layer is an ionomer resin, the mid layer includes a composition (M) that is formed from:

a high melt viscosity resin (A) that is an ionomer resin (a-1), a nonionic resin (a-2), or a mixture of the ionomer resin (a-1) and the nonionic resin (a-2), the ionomer resin (a-1) being a high melt viscosity ionomer resin that is at least one or more types selected from two types of:

a metal ion neutralized product (a-11) of a binary copolymer formed with ethylene and an α,β-unsaturated carboxylic acid having 3 to 8 carbon atoms; and a metal ion neutralized product (a-12) of a ternary copolymer formed with ethylene, an α,β-unsaturated carboxylic acid having 3 to 8 carbon atoms, and an α,β-unsaturated carboxylic acid ester, the high melt viscosity ionomer resin having a melt viscosity (190° C.), measured with a flow tester, of 500 Pa·s or greater and 100000 Pa·s or less, the nonionic resin (a-2) being a high melt viscosity nonionic resin that is at least one or more types selected from two types of: a binary copolymer (a-21) formed with ethylene and an α,β-unsaturated carboxylic acid having 3 to 8 carbon atoms; and a ternary copolymer (a-22) formed with ethylene, an α,β-unsaturated carboxylic acid having 3 to 8 carbon atoms, and an α,β-unsaturated carboxylic acid ester, the high melt viscosity nonionic resin having a melt viscosity (190° C.), measured with a flow tester, of 5 Pa·s or greater and 3000 Pa·s or less;

a low melt viscosity ionomer resin (B) is at least one or more types selected from two types of: a metal ion neutralized product (b-1) of a binary copolymer formed with ethylene and an α,β-unsaturated carboxylic acid having 3 to 8 carbon atoms; and a metal ion neutralized product (b-2) of a ternary copolymer formed with ethylene, an α,β-unsaturated carboxylic acid having 3 to 8 carbon atoms, and an α,β-unsaturated carboxylic acid ester, the low melt viscosity ionomer resin (B) having a melt viscosity (190° C.), measured with a Brookfield viscometer, of 1 Pa·s or greater and 10 Pa·s or less; and a metal ion source (C1) that can neutralize carboxyl groups in the high melt viscosity resin (A) and the low melt viscosity ionomer resin (B), wherein the weight ratio A1/B1 of the high melt viscosity resin (A) with respect to the low melt viscosity ionomer resin (B) is equal to or greater than 55/45 and equal to or less than 99/1, the amount of the metal ion source (C1) is equal to or greater than 0.1 part by weight and equal to or less than 10 parts by weight, per total 100 parts by weight of the high melt viscosity resin (A) and the low melt viscosity ionomer resin (B), the mid layer has a melt flow rate, measured under the conditions of: a temperature of 190° C. and a load of 2.16 kg, of 4 g/10 min or greater, and the difference (H3-H1) between the JIS-C hardness H3 of the cover and the JIS-C central hardness H1 of the center is equal to or greater than 45.

2. The golf ball according to claim 1, wherein the mid layer includes a thermoplastic resin (D) in an amount that is equal to or greater than 1 part by weight and equal to or less than 95 parts by weight per total 100 parts by weight of the high melt viscosity resin (A) and the low melt viscosity ionomer resin (B).

3. The golf ball according to claim 1, wherein the mid layer has a specific gravity G2 of 1.10 or greater and 1.50 or less.

4. The golf ball according to claim 1, wherein the cover has a thickness of 0.3 mm or greater and 1.6 mm or less.

5. The golf ball according to claim 1, wherein the center has a specific gravity of 1.00 or greater and 1.15 or less.

6. The golf ball according to claim 1, wherein the center has a surface hardness H5 of 30 or greater and 70 or less.

7. The golf ball according to claim 1, wherein the center and the envelope layer constitute a core, and the core has a surface hardness H4 of 65 or greater and 95 or less.

8. The golf ball according to claim 1, wherein the hardness H2 of the mid layer is equal to or greater than 62 and equal to or less than 86.

9. The golf ball according to claim 1, wherein the hardness H3 of the cover is equal to or greater than 85 and equal to or less than 98.

* * * * *